US007999764B2

(12) United States Patent
Cho

(10) Patent No.: US 7,999,764 B2
(45) Date of Patent: Aug. 16, 2011

(54) PLASMA DISPLAY APPARATUS

(75) Inventor: Janghwan Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 1007 days.

(21) Appl. No.: 11/853,953

(22) Filed: Sep. 12, 2007

(65) Prior Publication Data

US 2008/0062077 A1 Mar. 13, 2008

(30) Foreign Application Priority Data

Sep. 12, 2006 (KR) ..... 10-2006-0088310

(51) Int. Cl.
*G09G 3/28* (2006.01)

(52) U.S. Cl. ..... 345/60; 345/63

(58) Field of Classification Search ..... 345/60–72
See application file for complete search history.

(56) References Cited

U.S. PATENT DOCUMENTS

| | | | | |
|---|---|---|---|---|
| 5,670,974 | A * | 9/1997 | Ohba et al. | 345/60 |
| 6,011,355 | A * | 1/2000 | Nagai | 315/169.3 |
| 6,111,556 | A * | 8/2000 | Moon | 345/60 |
| 6,160,531 | A | 12/2000 | Chen et al. | 345/60 |
| 6,538,627 | B1 * | 3/2003 | Whang et al. | 345/60 |
| 7,166,967 | B2 * | 1/2007 | Cho et al. | 315/169.3 |
| 2003/0080925 | A1 * | 5/2003 | Lee | 345/60 |
| 2003/0090440 | A1 * | 5/2003 | Marcotte | 345/60 |
| 2004/0075626 | A1 * | 4/2004 | Lee et al. | 345/60 |
| 2005/0012690 | A1 * | 1/2005 | Choi | 345/60 |
| 2005/0088376 | A1 * | 4/2005 | Inoue et al. | 345/60 |
| 2005/0116887 | A1 * | 6/2005 | Lee et al. | 345/60 |
| 2005/0190123 | A1 * | 9/2005 | Choi et al. | 345/60 |
| 2005/0200562 | A1 * | 9/2005 | Lee et al. | 345/60 |
| 2005/0200564 | A1 * | 9/2005 | Yim et al. | 345/60 |
| 2006/0109213 | A1 * | 5/2006 | Chae et al. | 345/67 |
| 2006/0152448 | A1 * | 7/2006 | Hatanaka et al. | 345/68 |
| 2006/0244684 | A1 * | 11/2006 | Kong et al. | 345/60 |
| 2009/0213044 | A1 * | 8/2009 | Ploquin et al. | 345/60 |

FOREIGN PATENT DOCUMENTS

| | | | |
|---|---|---|---|
| EP | 0 704 834 | B1 | 1/2001 |
| EP | 1 507 250 | A2 | 2/2005 |
| JP | 08-152865 | A | 6/1996 |
| KR | 10-2003-0088634 | A | 11/2003 |
| KR | 10-2004-0009333 | A | 1/2004 |
| KR | 10-2006-0056156 | A | 5/2006 |
| WO | WO 2004/097778 | A1 | 11/2004 |

OTHER PUBLICATIONS

European Search Report dated Dec. 20, 2007.
Korean Decision to Grant a Patent dated Jan. 16, 2008.

* cited by examiner

*Primary Examiner* — Amare Mengistu
*Assistant Examiner* — Gene W Lee
(74) *Attorney, Agent, or Firm* — KED & Associates, LLP

(57) ABSTRACT

A plasma display apparatus comprises a plasma display panel and a first driver. The plasma display panel includes a first electrode and a second electrode. The first driver includes an inductor into which a current flows in a first direction before and after a voltage between the first electrode and the second electrode rises from a negative polarity sustain voltage and into which a current flows in a second direction different from the first direction before and after the voltage between the first electrode and the second electrode falls from a positive polarity sustain voltage.

28 Claims, 16 Drawing Sheets

PLASMA DISPLAY APPARATUS

This nonprovisional application claims priority under 35 U.S.C. §119(a) on Patent Application No. 10-2006-0088310 filed in Republic of Korea on Sep. 12, 2006 the entire contents of which are hereby incorporated by reference.

BACKGROUND

1. Field

This document relates to a plasma display apparatus.

2. Related Art

In general, the plasma display apparatus comprises a plasma display panel (PDP) that displays images and a driver attached on a rear surface of the PDP to drive the PDP.

In the PDP that displays images, a plurality of discharge cells are formed to be divided by barrier ribs between front and rear substrates and filled with an inert gas containing such as neon (Ne), helium (He) or a mixture gas of Ne+He as a primary discharge gas and a small amount of xenon (Xe). Several discharge cells group to form a single pixel. That is, for example, red, green and blue discharge cells form a single pixel.

When a discharge occurs by an RF (Radio Frequency) voltage in the PDP, the inert gas generates vacuum ultraviolet rays and illuminates phosphors formed between the barrier ribs to display images. Because the PDP is thinner and lighter, it receives much attention as a display device.

SUMMARY

In one aspect, a plasma display apparatus comprises a plasma display panel including a first electrode and a second electrode; and a first driver including an inductor into which a current flows in a first direction before and after a voltage between the first electrode and the second electrode rises from a negative polarity sustain voltage and into which a current flows in a second direction different from the first direction before and after the voltage between the first electrode and the second electrode falls from a positive polarity sustain voltage.

In another aspect, a plasma display apparatus comprises a plasma display panel including a first electrode and a second electrode; a first sustain controller that supplies a positive polarity voltage supplied from a positive polarity constant voltage source to the first electrode so that a voltage between the first electrode and the second electrode is maintained at the positive polarity sustain voltage; a second sustain controller that supplies the positive polarity sustain voltage to the second electrode so that a voltage between the first electrode and the second electrode is maintained at a negative polarity sustain voltage; and an inductor unit into which a current flows in a first direction before and after a voltage between the first electrode and the second electrode rises from the negative polarity sustain voltage and into which a current flows in a second direction different from the first direction before and after the voltage between the first electrode and the second electrode falls from the positive polarity sustain voltage.

BRIEF DESCRIPTION OF THE DRAWINGS

The implementation of this document will be described in detail with reference to the following drawings in which like numerals refer to like elements.

DETAILED DESCRIPTION

Hereinafter, an implementation of this document will be described in detail with reference to the attached drawings.

Exemplary embodiments of the present invention will now be described with reference to the accompanying drawings.

Figure 1:
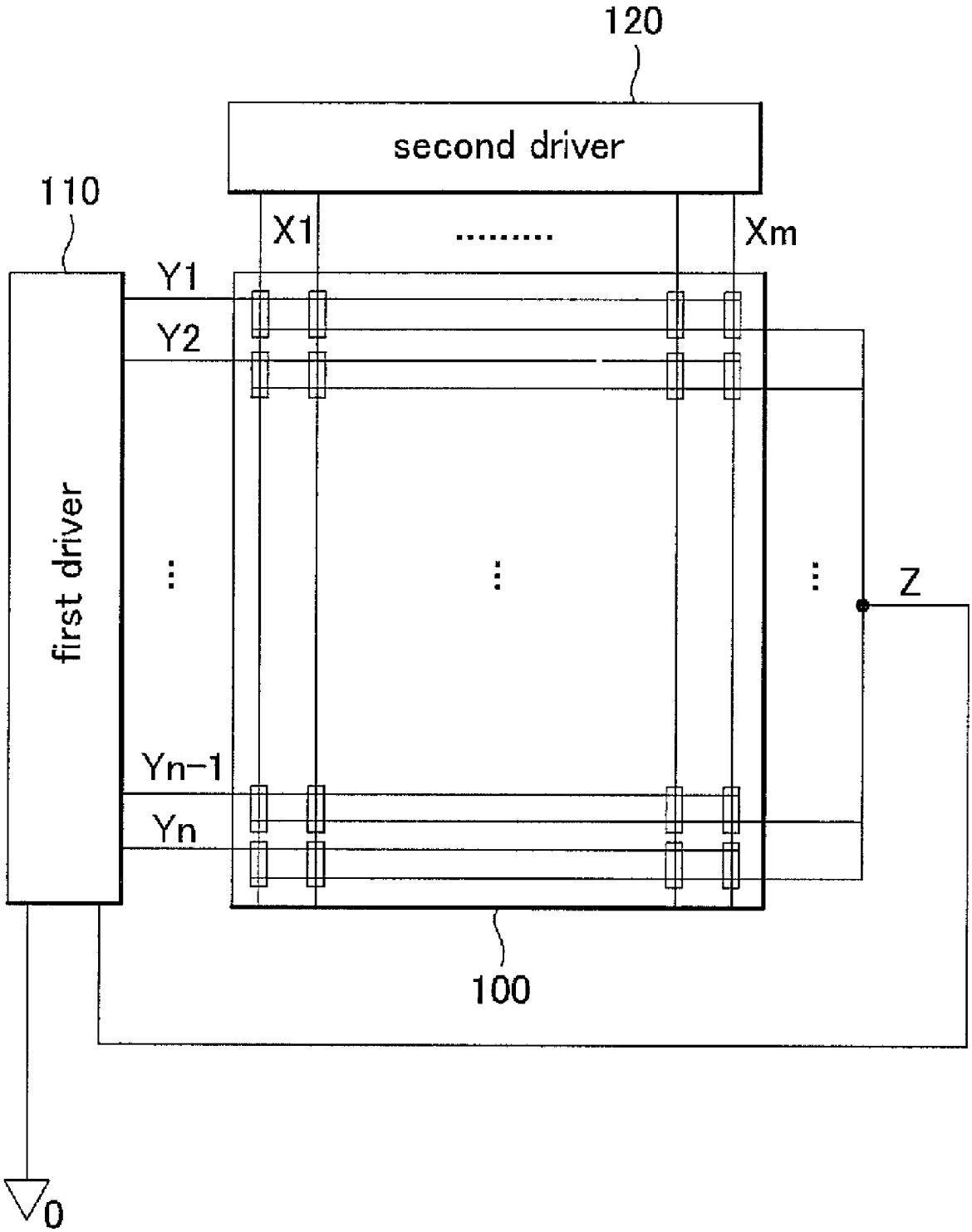
FIG. 1 is a view illustrating an example of a plasma display apparatus to which this document is applied.

As shown in FIG. 1, a plasma display apparatus according to an exemplary embodiment of the present invention comprises a plasma display panel (PDP) 100 comprising first electrodes (Y), second electrodes (Z) and data electrodes, a first driver 110, and a second driver 120.

Respective drivers 110 and 120 supply driving voltages to the plurality of electrodes formed on the PDP 100 in one or more subfields included in a frame.

The first driver 110 drives the first electrodes Y1~Yn and the second electrodes (Z) of the PDP 100. The first electrodes Y1~Yn may be one of sustain electrodes and scan electrodes, and the second electrodes (Z) may be the other of the sustain electrodes and the scan electrodes, excluding the first electrodes.

The first driver 110 may supply a reset signal to the first electrodes Y1~Yn in order to form uniform wall charges on discharge cells. In addition, the first driver 110 supplies scan signals for selecting discharge cells for emitting light and sustain signals for allowing the selected discharge cells to emit light to the first electrode Y1~Yn and the second electrode (Z).

The sustain driver of the first driver 110 supplies the sustain signals to the first electrode Y1~Yn and the second electrode (Z). The first driver 110 comprises an inductor at which a first directional current flows before and after a voltage between the first electrodes Y1~Yn and the second electrodes (Z) rises from a negative polarity sustain voltage and a second directional current flows before and after the voltage between the first electrodes Y1~Yn and the second electrodes (Z) falls from a positive polarity sustain voltage.

In other words, when the voltage between the first electrodes Y1~Yn and the second electrodes (Z) is maintained at the negative polarity sustain voltage, the inductor is charged with energy by the first directional current. When the voltage between the first electrodes Y1~Yn and the second electrodes (Z) falls from the voltage negative polarity sustain voltage, the inductor emits the charged energy to thus shorten a falling time taken for the voltage to fall from the positive polarity sustain voltage to the negative polarity sustain voltage. Likewise, when the voltage between the first electrodes Y1~Yn and the second electrodes (Z) is maintained at the positive polarity sustain voltage, the inductor is charged with energy by the second directional current. When the voltage between the first electrodes Y1~Yn and the second electrodes (Z) rises from the positive polarity sustain voltage, the inductor emits the charged energy to thus shorten a rising time taken for the voltage to rise from the negative polarity sustain voltage to the positive polarity sustain voltage. Because the rising time and the falling time are shortened, a drive margin during the sustain period can be improved.

The second driver 120 supplies data signals to the third electrodes X1~Xm formed on the PDP 100.

Figure 2:
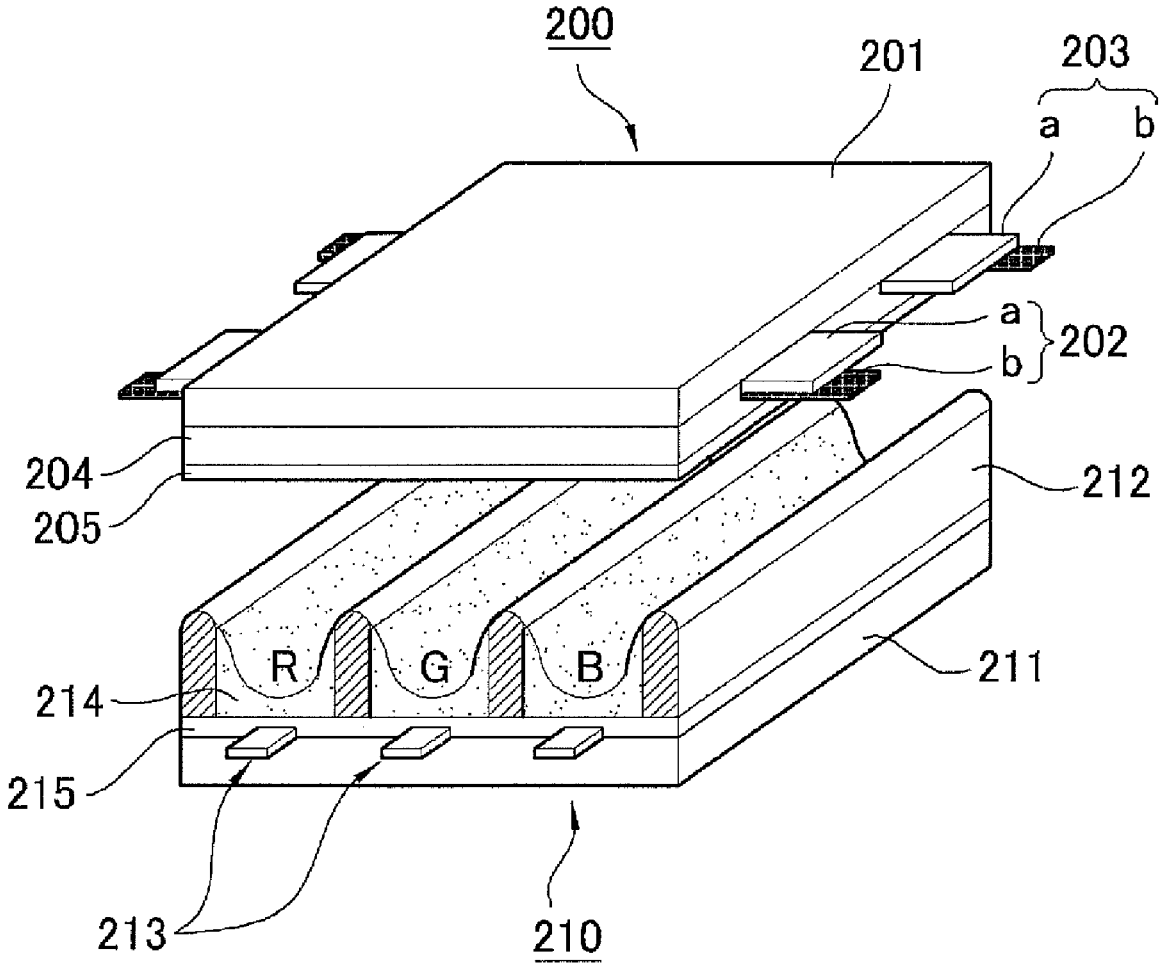
FIG. 2 is a view illustrating an example of the structure of a plasma display panel (PDP) in FIG. 1.

As shown in FIG. 2, the PDP 100 comprises a front panel 200 constructed such that the first electrodes 202 (Y) and the second electrodes 203 (Z) are formed to maintain discharges on a front substrate 201, a display surface on which images are displayed, and a rear panel 210 constructed such that a plurality of third electrodes 213 (X) are arranged to cross the first electrodes 202 (Y) and the second electrodes 203 (Z) on a rear substrate 211. The front and rear panels 200 and 210 are attached with a certain gap therebetween.

The front panel 200 comprises the first electrodes 202 (Y) and the second electrodes 203 (Z) that perform mutual discharges in a single discharge space, namely, in a single discharge cell, and maintain illumination of the discharge cell. The sustain electrodes may include the first electrodes 202 (Y) and the second electrodes 203 (Z) as pairs, each comprising a transparent electrode (a) made of a transparent ITO material and a bus electrode (b) made of a metallic material. The first electrodes 202 (Y) and the second electrodes 203 (Z) may be covered by an upper dielectric layer 204 (or dielectric layers) that limits a discharge current and insulates the pairs of electrodes. A protection layer 205 may be formed by depositing magnesium oxide (MgO) on an upper surface of the upper dielectric layer 204 in order to facilitate discharge conditions.

On the rear panel 210, there may be arranged barrier ribs 212 in a stripe type (or a well type), forming the plurality of discharge spaces, namely, the discharge cells. In addition, the plurality of third electrodes 213 (X) may be disposed to be parallel with the barrier ribs 212 and perform address discharges to generate vacuum ultraviolet rays. R, G, and B phosphors 2124 are coated on the upper surfaces of the rear panel 210 in order to emit visible rays for displaying images during the address discharges. A lower dielectric layer 215 may be formed between the third electrodes 213 (X) and the phosphors 214 in order to protect the third electrodes 213 (X).

FIG. 1 shows only an example of the PDP and the present invention is not limited thereto.

For example, in the PDP as shown in FIG. 2, the first electrodes 202 (Y) and the second electrodes (Z), the sustain electrodes, comprise the transparent electrodes 202*a* and 203*a* and the bus electrodes 202*b* and 203*b*, respectively. But alternatively, one or more of the first electrodes 202 (Y) and the second electrodes 203 (Z) may comprise only the bus electrodes 202*b* and 203*b*.

In addition, for example, the upper dielectric layer 204 as shown in FIG. 2 has the uniform thickness, but it may have different thickness and dielectric constants by regions. Also, intervals of the barrier ribs 212 as shown in FIG. 2 are uniform, but the space between the barrier ribs 212 of the discharge cell 'B' may be wider.

Moreover, the side surfaces of the barrier ribs 212 may have a depressed (Intaglioed) and raised (embossed) pattern and the phosphor layer 214 is coated thereon accordingly, thereby enhancing luminance of an image displayed on the PDP.

A tunnel may be formed at the side of the barrier ribs 212 in the process of fabricating the PDP in order to improve evacuating characteristics.

In case where one of the first electrodes 202 (Y) and the second electrodes 203 (Z) are not formed and signals for maintaining discharge are supplied to the other remaining electrodes and the third electrodes 213 (X), the other remaining electrodes and the third electrodes 213 (X) serve as the sustain electrodes. In FIG. 2, the electrodes of the panel comprise the first electrodes 202 (Y), the second electrodes 203 (Z) and the third electrodes 213 (X). Accordingly, the following descriptions will be made based on the three-electrode structure.

Figure 3:
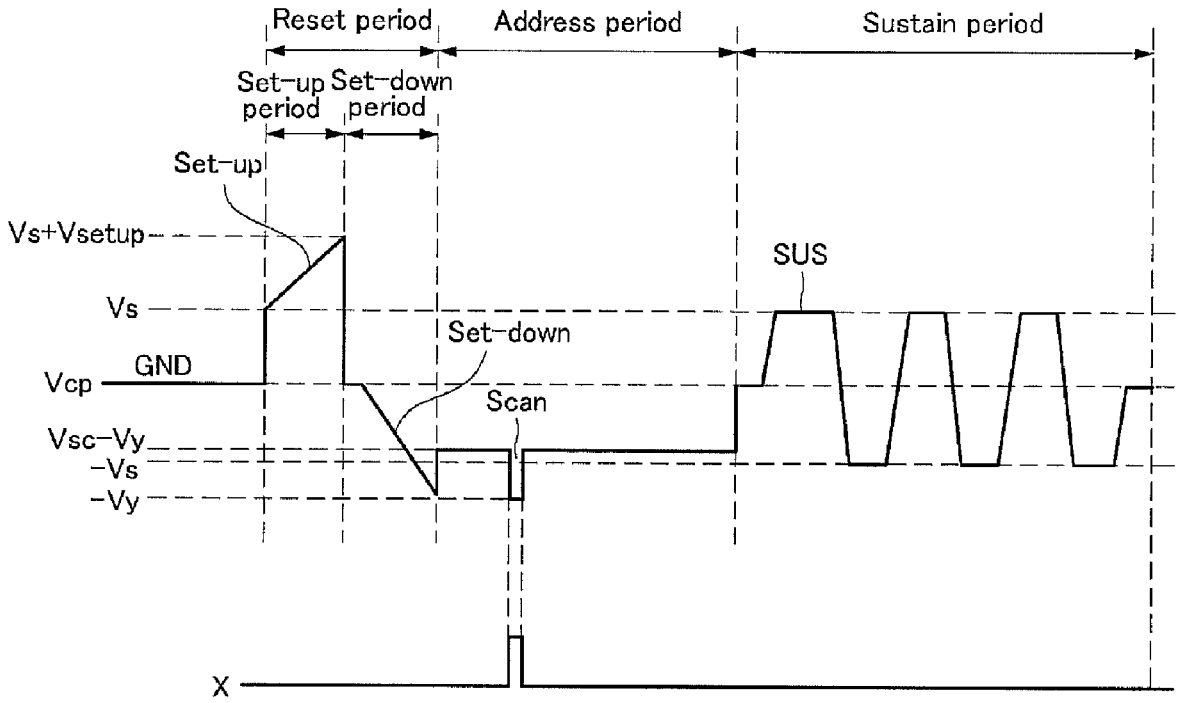
FIG. 3 is a view illustrating a method of driving the PDP.

As shown in FIG. 3, the drivers 110 and 120 in FIG. 1 supply drive signals to the first electrodes (Y), the second electrodes (Z), and the third electrodes (X) during one or more of a reset period, an address period, and a sustain period. Here, Vcp is a voltage between the first electrodes (Y) and the second electrodes (Z).

The first driver 110 may supply a set-up signal (Set-up) to the first electrodes (Y) during a set-up period of the reset period. A weak dark discharge occurs within the discharge cells of the entire screen according to the set-up signal (Set-up). According to the set-up discharge, positive polarity wall charges are accumulated in the third electrodes (X) and the second electrodes (Z) and negative polarity wall charges are accumulated in the first electrodes (Y).

Also, after supplying a set-down signal (Set-down) to the first electrodes (Y) during a set-down period of the reset period, the first driver 110 may supply a set-down signal that falls from a positive polarity voltage lower than a maximum voltage of the set-up signal (Set-up) to a voltage below a ground level voltage (GND). Accordingly, a weak erase discharge occurs within the discharge cells to erase the wall charges which have been excessively formed within the discharge cells. Due to the set-down discharge, wall charges, that allow stable address discharge to occur, can remain uniformly in the discharge cells.

The first driver 110 may supply a negative polarity scan signal Scan that falls from a scan bias voltage Vsc-Vy to the first electrodes (Y) during the address period. The second driver 120 supplies a data signal in synchronization with the scan signal (Scan) to the third electrodes (X). When a voltage difference between the scan signal (Scan) and the data signal and a wall voltage generated during the reset period are added, the address discharge occurs within the discharge cells to which the data signal is applied. Wall charges, that are sufficient to allow discharge to occur when a sustain voltage (Vs) is applied, are formed within the discharge cells selected by the address discharge.

During the sustain period, the sustain driver of the first driver 110 supplies a sustain signal SUS to the first and second electrodes Y and Z, the sustain electrodes. In the discharge cells selected by the address discharge, whenever the sustain signal SUS is applied as the wall voltage of the discharge cells and the sustain signal SUS are added, a sustain discharge occurs between the first and second electrodes Y and Z. The positive polarity sustain voltage Vs is a maximum voltage of the sustain signal SUS, and a negative polarity sustain voltage −Vs is a minimum voltage of the sustain signal SUS.

The above-described driving method shows one example and an erasing period may be added.

Figure 4:
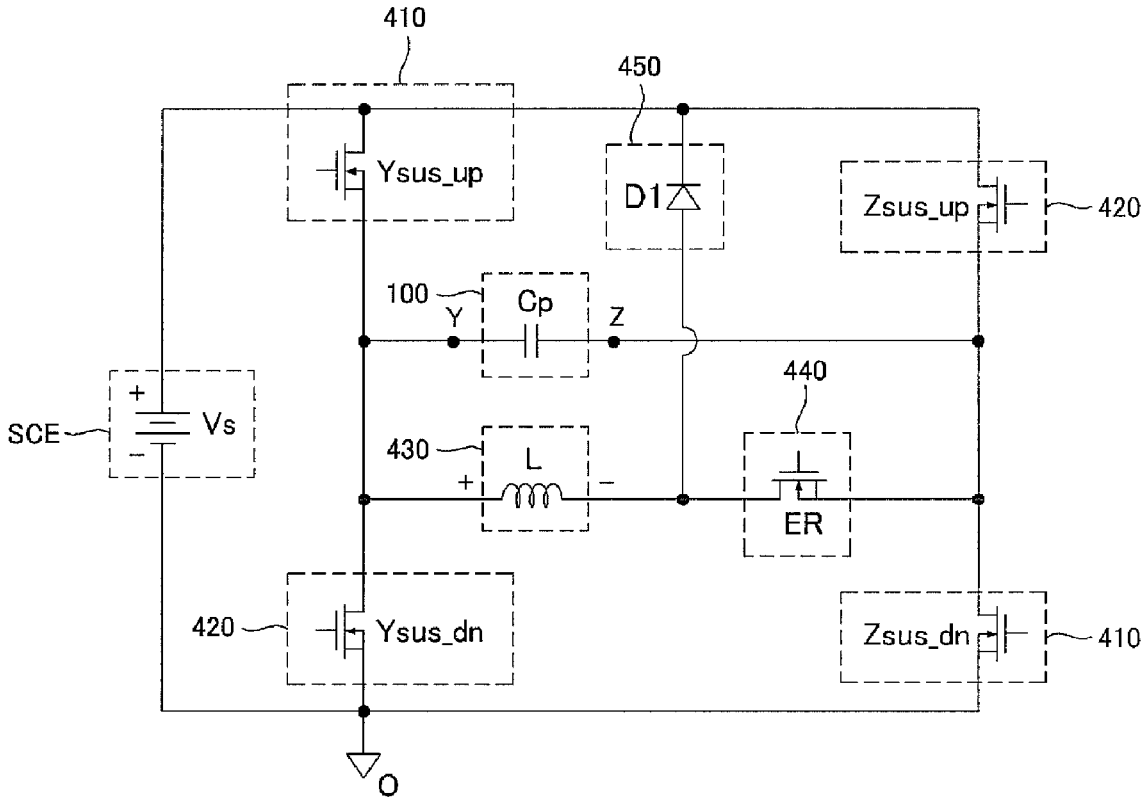
FIG. 4 is a view illustrating an example of a sustain driver of a first driver.

As shown in FIG. 4, the first driver 110 comprises a first sustain controller 410, a second sustain controller 420, and an inductor unit 430, and it may further comprise a resonance controller 440 and a bypass unit 450.

The first sustain controller 410 is turned on to maintain the positive polarity sustain voltage Vs between the first and second electrodes Y and Z. The positive polarity sustain voltage Vs is supplied from a positive polarity constant voltage source SCE.

The first sustain controller 410 comprises a first sustain switch Ysus_up that supplies the positive polarity sustain voltage Vs to the first electrodes (Y), and a first reference switch Zsus_dn that supplies the reference voltage of ground level GND to the second electrodes (Z). One end of the first sustain switch Ysus_up is connected with the positive polarity constant voltage source SCE and the other end of the first sustain switch Ysus_up is connected with the first electrode (Y) of the panel Cp.

The second sustain controller 420 maintains the negative polarity sustain voltage −Vs between the first and second electrodes Y and Z. The second sustain controller 420 comprises a second sustain switch Zsus_up that supplies the positive polarity sustain voltage Vs to the second electrodes (Z) and a second reference switch Ysus_dn that supplies the reference voltage of ground level GND to the first electrodes (Y). One end of the second sustain switch Zsus_up is connected with the positive polarity constant voltage source SCE and the other end of the second sustain switch Zsus_up is connected with the second electrodes (Z) of the panel Cp.

The inductor unit 430 is electrically connected with the PDP Cp, forming resonance with the PDP. The current in the first direction flows through the inductor unit 430 before and after the voltage between the first and second electrodes Y and Z rises from the negative polarity sustain voltage. In addition, the current in the second direction, different from the first direction, flows through the inductor unit 430 before and after the voltage between the first and second electrodes Y and Z falls from the positive polarity sustain voltage. The inductor unit 430 comprises an inductor (L). One end of the inductor (L) is commonly connected with the first electrodes (Y), the other end of the first sustain switch Ysus_up, and one end of the second reference switch Ysus_dn.

The resonance controller 440 controls such that the voltage between the first and second electrodes Y and Z falls from the positive polarity sustain voltage Vs to the reference voltage GND of the ground level or rises from the negative polarity sustain voltage −Vs to the reference voltage GND of the ground level because of resonance formed by the PDP Cp and the inductor unit 430.

The resonance controller 440 comprises a resonance switch ER. One end of the resonance switch ER is connected with the other end of the inductor (L), and the other end of the resonance switch ER is commonly connected with the second electrodes (Z), the other end of the second sustain switch Zsus_up, and one end of the first reference switch Zsus_dn. When the resonance switch ER is turned on, the voltage between the first and second electrodes Y and Z is changed to the reference voltage GND of the ground level because of the resonance formed by the inductor (L) and the PDP Cp.

The bypass unit 450 comprises a bypass diode D1. An anode of the bypass diode D1 is commonly connected with the other end of the inductor (L) and one end of the resonance switch ER, and a cathode of the bypass diode D1 is commonly connected with the positive polarity constant voltage source SCE, one end of the first sustain switch Ysus_up and one end of the second sustain switch Zsus_up. After the voltage between the first and second electrodes Y and Z is changed to the reference voltage, the bypass diode D1 allows the current flowing at the inductor (L) to come out to the positive polarity constant voltage source SCE.

Figure 5:
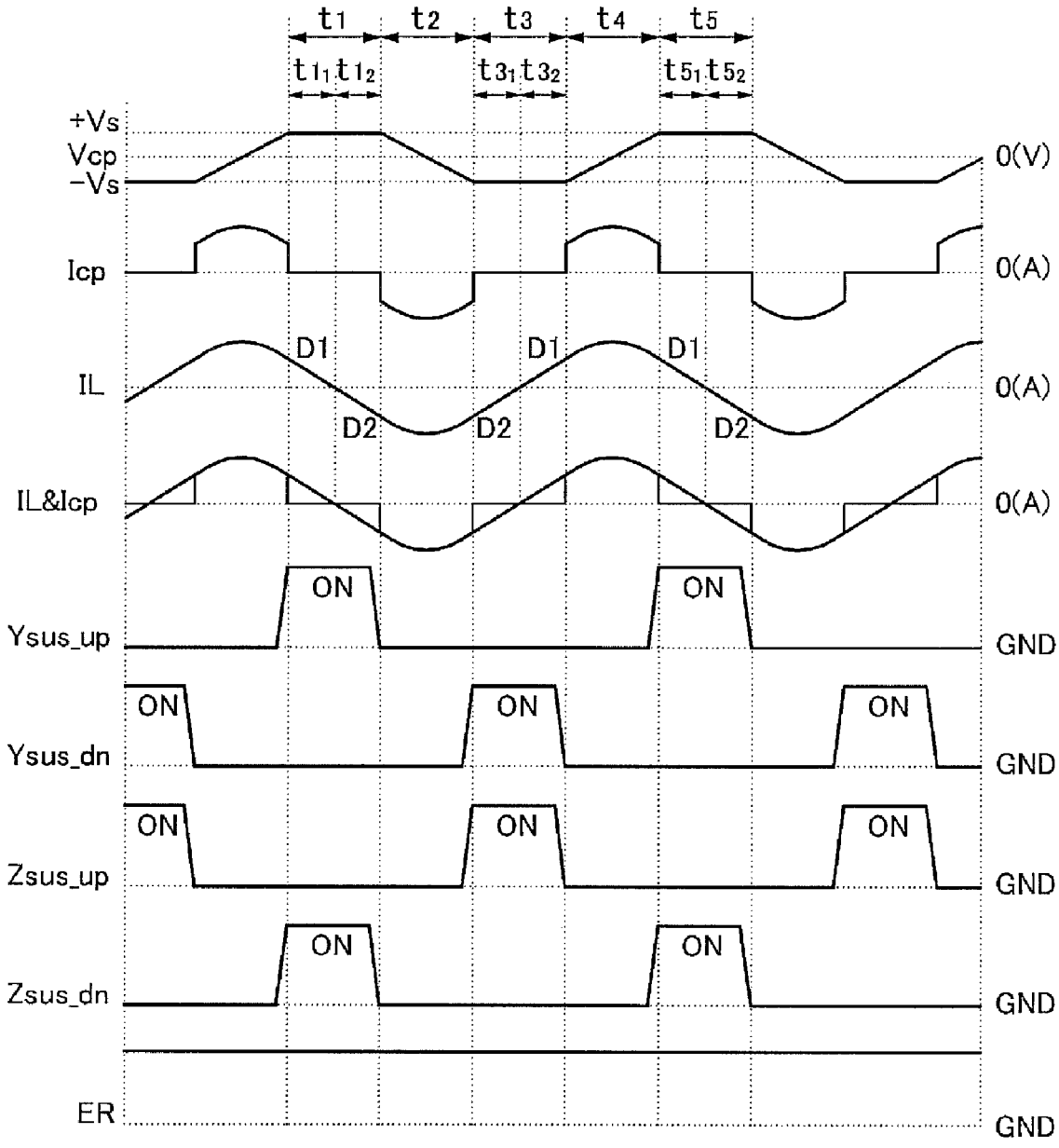
FIG. 5 is timing diagram illustrating an example of a method of supplying a first sustain signal to the PDP by the sustain driver in FIG. 4.

With reference to FIG. 5, Vcp is a voltage between the first and second electrodes Y and Z. Icp is a current that flows to the first and second electrodes Y and Z. IL is a current flowing at the inductor (L). IL&Icp shows a comparison of the currents IL and Icp. FIG. 5 shows a timing diagram of the first sustain switch Ysus_up, the first reference switch Zsus_dn, the second sustain switch Zsus_up, the second reference switch Ysus_dn, and the resonance switch ER.

First, the voltages Vcp and IL will be described in detail. While the voltage Vcp between the first and second electrodes Y and Z is maintained at the positive polarity sustain voltage +Vs during time periods (t1 and t5), the direction of current IL flowing at the inductor (L) changes from a first direction D1 to a second direction D2.

While the voltage Vcp between the first and second electrodes Y and Z falls from the positive polarity sustain voltage +Vs to the negative polarity sustain voltage −Vs because of the resonance formed as the inductor (L) and the PDP Cp are electrically connected during a time period t2, the current IL flowing at the inductor (L) is maintained in the second direction D2.

At this time, the size of the current IL flowing at the inductor (L) during the time period t2 while the voltage between the first and second electrodes Y and Z falls from the positive polarity sustain voltage +Vs to the negative polarity sustain voltage −Vs because of the resonance is larger than that of the current flowing in the second direction at the inductor (L) during the time periods t1 and t5 while the voltage between the first and second electrodes Y and Z is maintained at the positive polarity sustain voltage +Vs.

Because the current continuously flows to the inductor (I) during the periods t1 and t5 while the voltage Vcp between the first and second electrodes Y and Z is maintained at the positive polarity sustain voltage +Vs, the inductor (L) is charged with energy, and because the previously charged energy of the inductor (L) is used during the time period t2 while the voltage Vcp between the first and second electrodes Y and Z falls, the falling time is shortened. Namely, because the current IL of the inductor (L) flowing in the second direction D2 increases after the time periods t1 and t5 during which the positive polarity sustain voltage +Vs is maintained, when the inductor (L) and the panel Cp form resonance, the size of the current Icp flowing to the panel Cp increases, shortening the time during which the voltage between the first and second electrodes Y and Z falls.

During the time period t3 while the voltage Vcp between the first and second electrodes Y and Z is maintained at the negative polarity sustain voltage −Vs, the direction of the current IL flowing at the inductor (L) is changed from the second direction D2 to the first direction D1. During a time period t4 while the voltage Vcp between the first and second electrodes Y and Z increases from the negative polarity sustain voltage −Vs to the positive polarity sustain voltage +Vs, the current IL in the first direction D1 flows at the inductor (L).

In this case, the size of the current IL flowing in the first direction D1 at the inductor (L) during the time period t4 while the voltage between the first and second electrodes Y and z rises from the negative polarity sustain voltage −Vs to the positive polarity sustain voltage +Vs is larger than that of the current in the first direction D1 flowing at the inductor (L) during the time period t3.

In this manner, while the voltage between the first and second electrodes Y and Z is maintained at the negative polarity sustain voltage −Vs, the current flows continuously at the inductor (L), so that the inductor (L) can be charged with energy, and when the voltage between the first and second electrodes Y and Z rises, the previously charged energy of the inductor (L) is used to shorten the rising time during which the voltage between the first and second electrodes Y and Z rises from the negative polarity sustain voltage −Vs to the positive polarity sustain voltage +Vs. In addition, because the positive polarity sustain voltage +Vs and the negative polarity sustain voltage −Vs are supplied from the single positive polarity constant voltage source SCE, the fabrication cost can be reduced.

FIGS. 6*a* to 6*f* are views illustrating operations of the sustain driver according to the timing in FIG. 5.

Figure 6A:
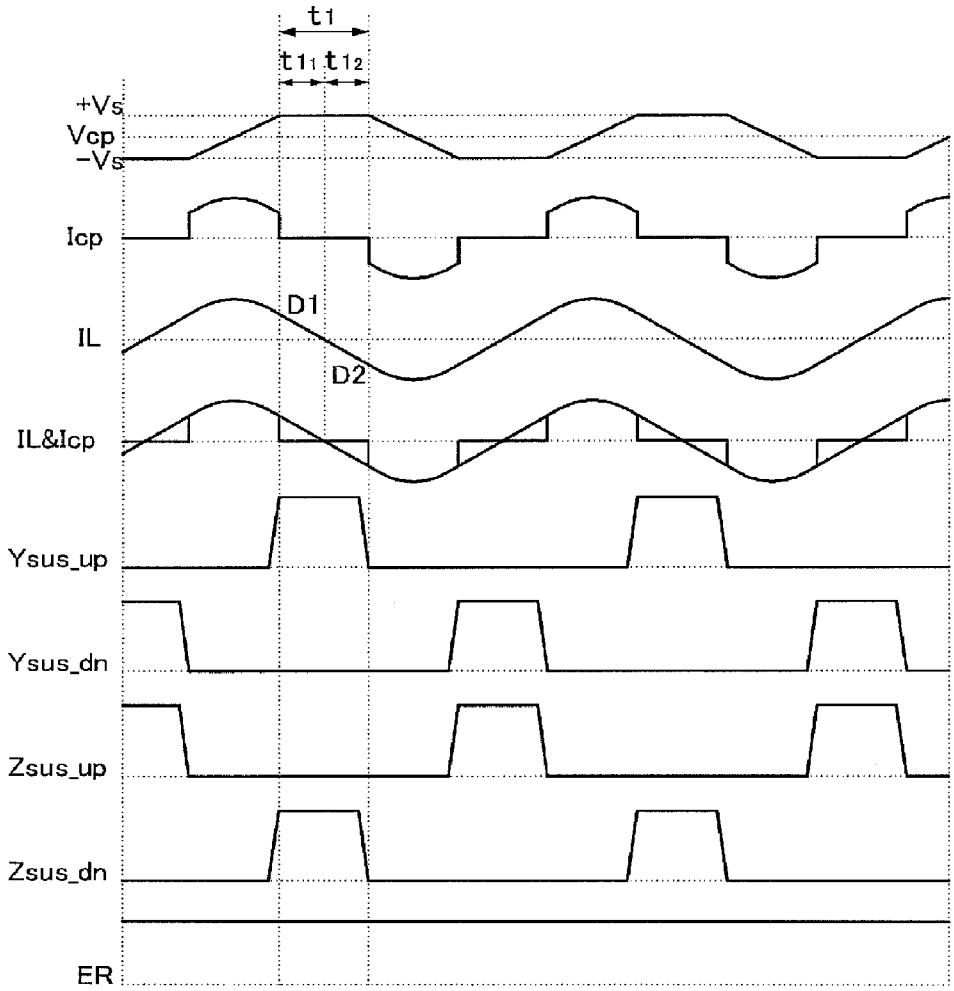
FIGS. 6*a* to 6*f* are views illustrating operations of the sustain driver according to the timing in FIG. 5.
Figure 6A:
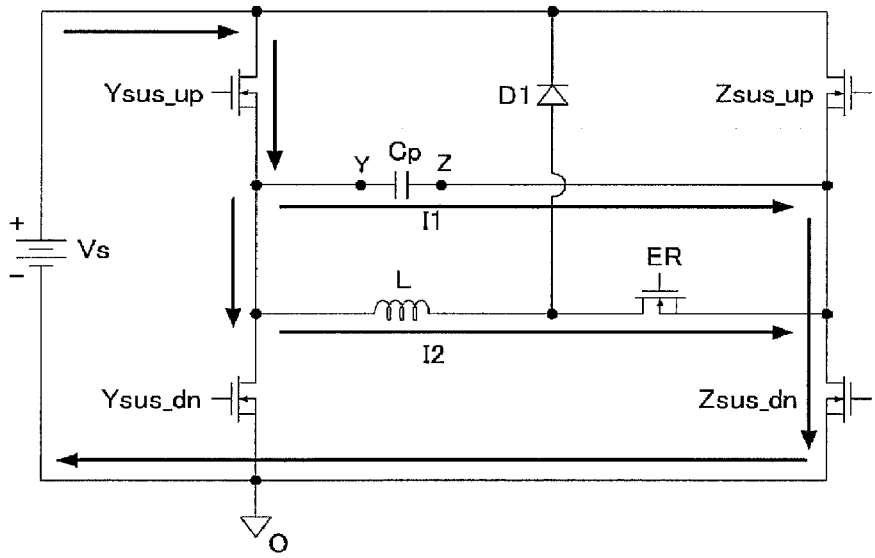

As shown in FIG. 6*a*, the first sustain switch Ysus_up, the first reference switch Zsus_dn, and the resonance switch ER are turned on during the time period t1. Accordingly, the voltage between the first and second electrodes is maintained at the positive polarity sustain voltage +Vs. The resonance switch ER is continuously maintained in the ON state (turned-on state), so the description on the resonance switch ER with reference to FIG. 6*f* will be omitted.

During the time period t1 while the voltage between the first and second electrodes Y and Z is maintained at the positive polarity sustain voltage +Vs, the direction of the current IL flowing at the inductor (L) is changed from the first direction D1 to the second direction D2.

During a time period $T1_1$, the size of the current in the first direction D1 flowing at the inductor (L) is gradually reduced. The description on the circuit operation during the time period $T1_1$ will be made with reference to FIG. 6*f* for the sake of explanation.

During a time period $t1_2$, a first current path I1 and a second current path I2 are formed. The voltage Vcp between the first and second electrodes Y and Z is maintained at the positive polarity sustain voltage +Vs by the first current path I1. The current in the second direction D2 flows at the inductor (L) by the second current path (I2). The size of the current in the second direction D2 is gradually increased.

Because the current IL flows at the inductor (L) during the time period t1 while the voltage between the first and second electrodes Y and Z is maintained at the positive polarity sustain voltage +Vs, the inductor (L) is previously charged with energy.

Figure 6B:
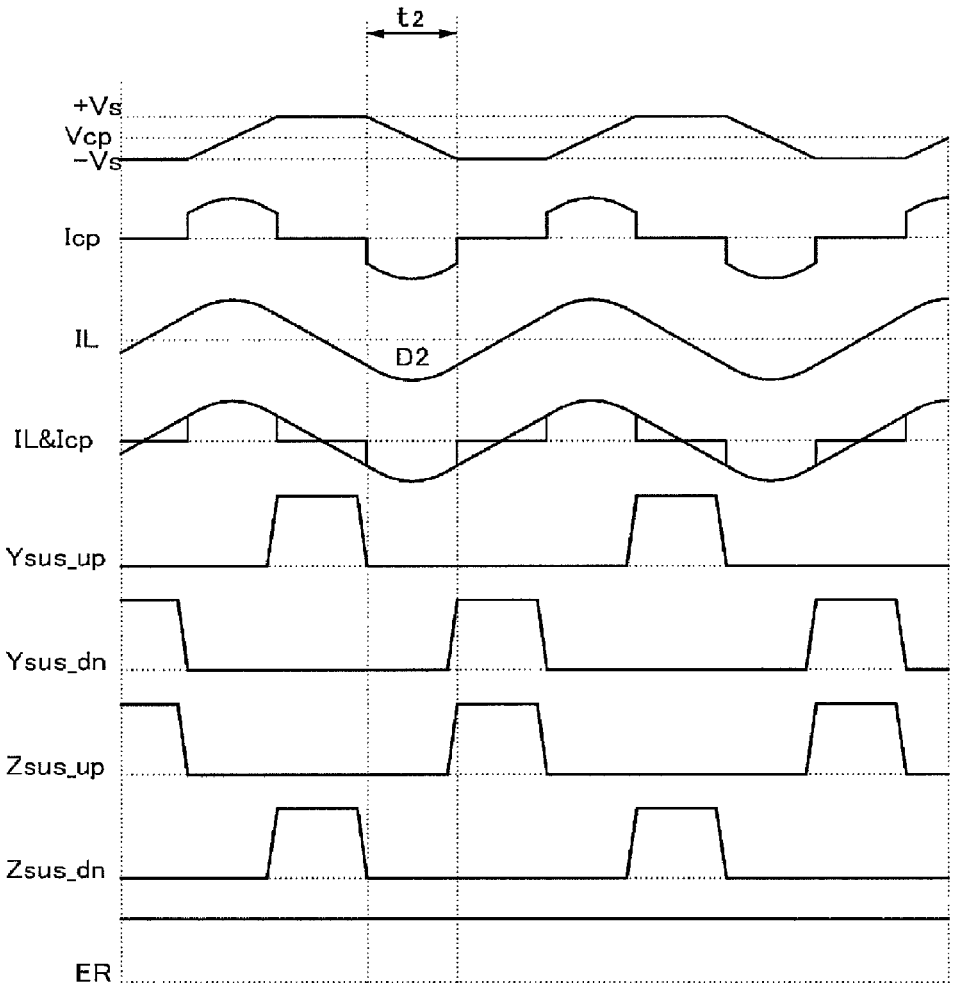
Figure 6B:
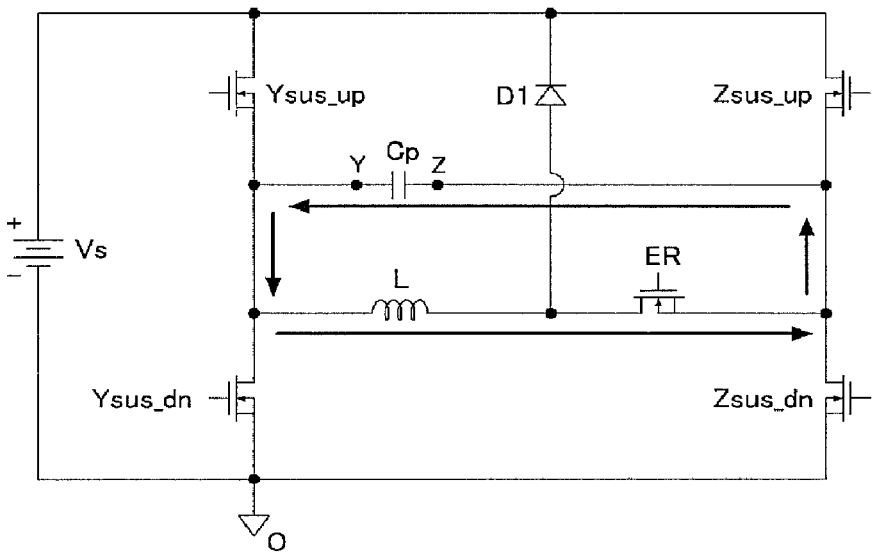

Thereafter, as shown in FIG. 6*b*, during the time period t2, the first sustain switch Ysus_up and the first reference switch Zsus_dn are turned off. The inductor (L) and the panel Cp form resonance and the voltage Vcp between the first and second electrodes Y and Z gradually falls from the positive polarity sustain voltage +Vs to the negative polarity sustain voltage −Vs.

The current IL of the inductor (L) is continuously maintained in the second direction D2, and the size of the current IL flowing at the inductor (L) in the second direction D2 at a time point when the first sustain switch Ysus_up and the first reference switch Zsus_dn are turned off is larger than that of the current IL flowing in the second direction D2 at the inductor (L) while the voltage Vcp between the first and second electrodes Y and Z is maintained at the positive polarity sustain voltage +Vs. Accordingly, the current Icp introduced to the panel Cp according to the resonance between the panel Cp and the inductor (L) is also increased to shorten the time period t2 during which the voltage Vcp between the first and second electrodes Y and Z falls.

For example, the falling period when the current flows at the inductor during the sustain voltage maintained period may be a half the falling period when the current does not flow at the inductor (L) during the sustain voltage maintained period. Because the falling period is reduced, the drive margin of the sustain period can be improved.

After the size of the current (IL) flowing at the inductor (L) is maximized, while the voltage between the first and second electrodes Y and Z falls from the voltage of the ground level to the negative polarity sustain voltage −Vs, the current in the second direction D2 flowing at the inductor (L) is gradually reduced.

Figure 6C:
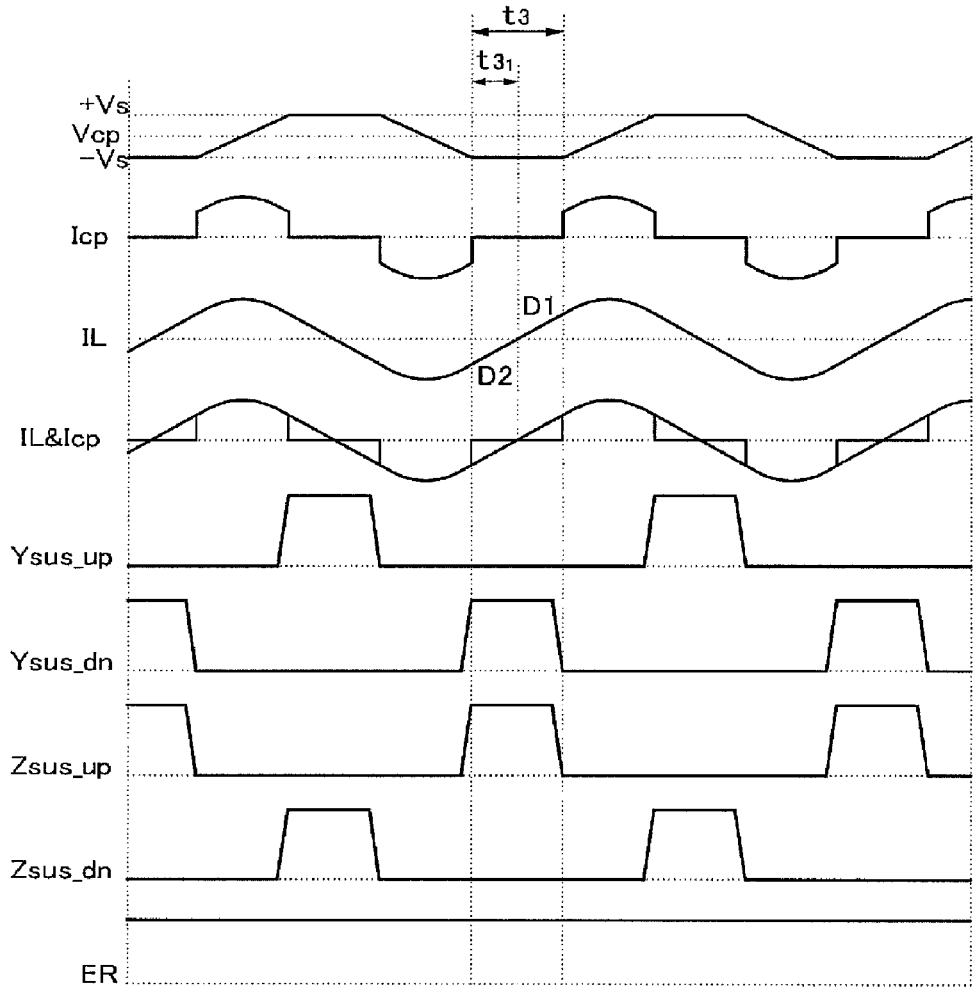
Figure 6C:
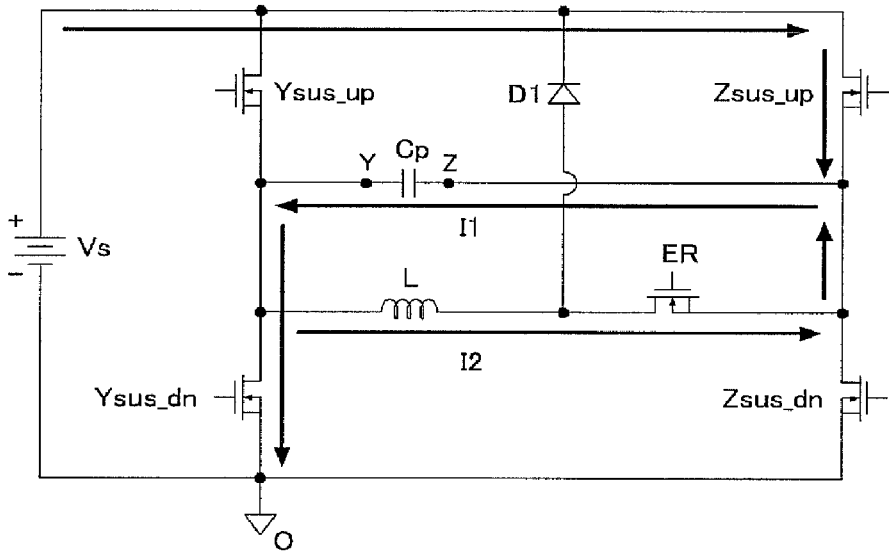

As shown in FIG. 6*c*, the second sustain switch Zsus_up and the second reference switch Ysus_dn are turned on during the time period t3. During a time period $t3_1$, first and second current paths I1 and I2 are formed. The voltage Vcp between the first and second electrodes Y and Z is maintained at the negative polarity sustain voltage −Vs by the first current path I1. The current that is gradually reduced flows in the second direction D2 at the inductor (L). Namely, the gradually reduced current IL in the second direction flows until the energy of the inductor (L) is completely discharged.

Figure 6D:
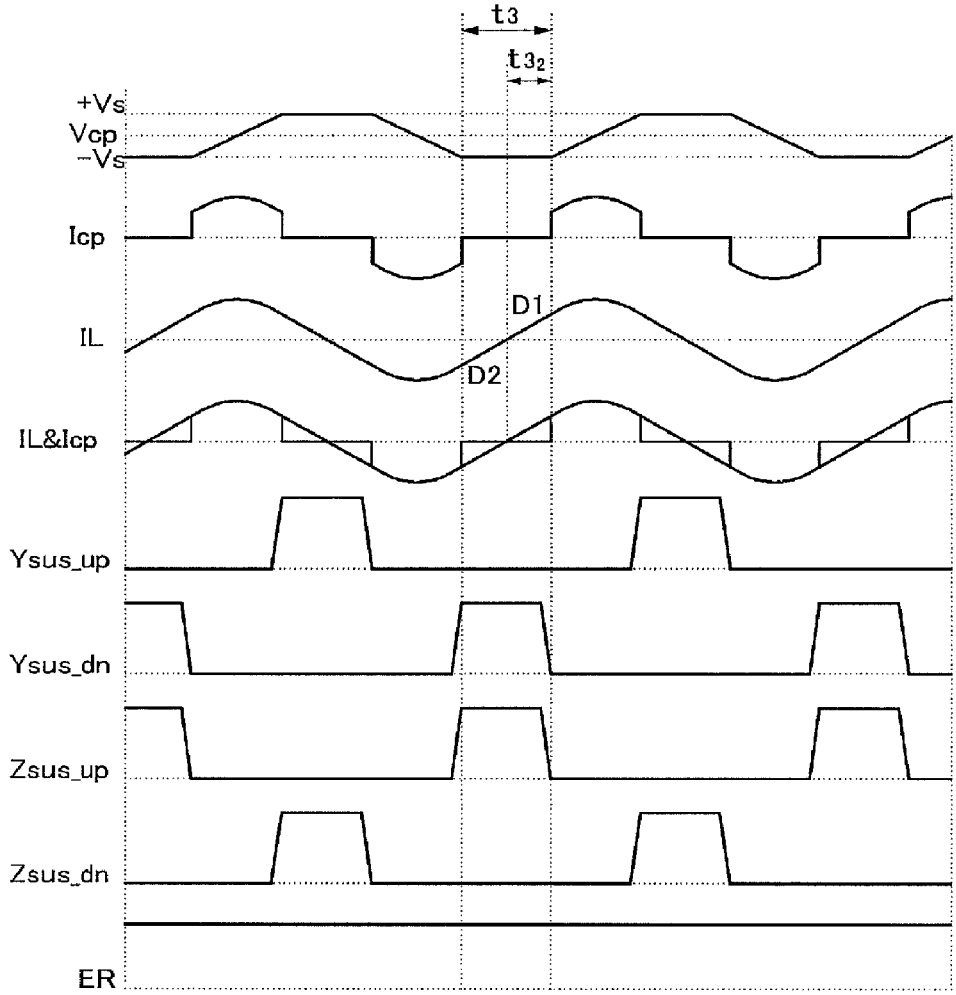
Figure 6D:
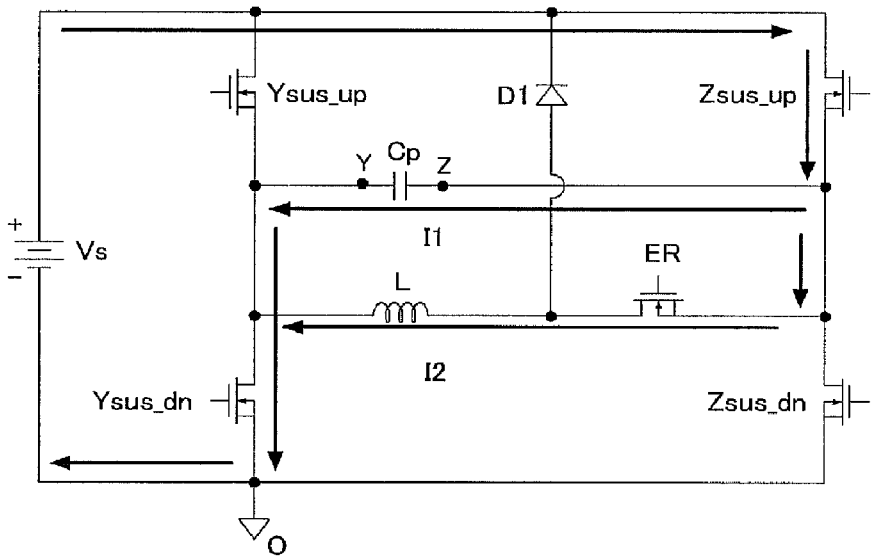

When the energy of the inductor (L) is completely discharged, as shown in FIG. 6*d*, the direction of the current flowing at the second current path is changed to the first direction D1 during a time period $t3_2$. Accordingly, the current IL in the first direction D1 is supplied by the positive polarity constant voltage source SCE, it is gradually increased.

Figure 6E:
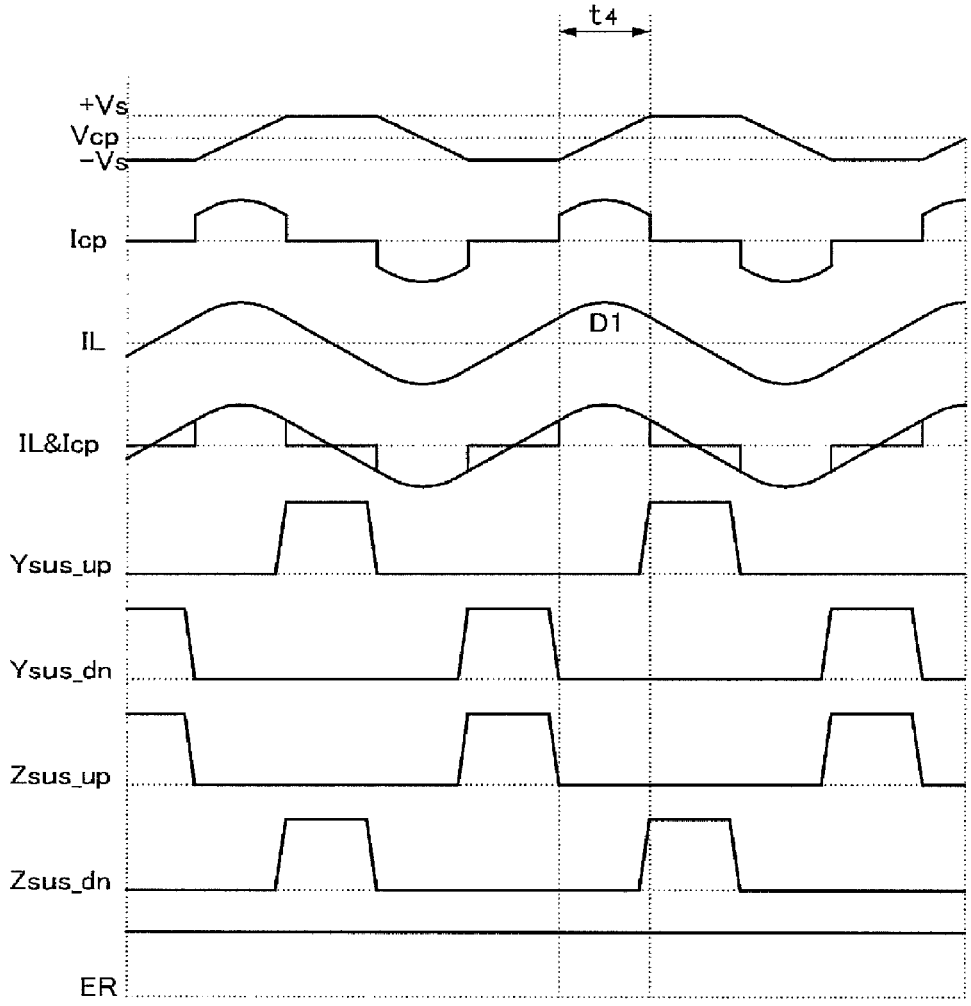
Figure 6E:
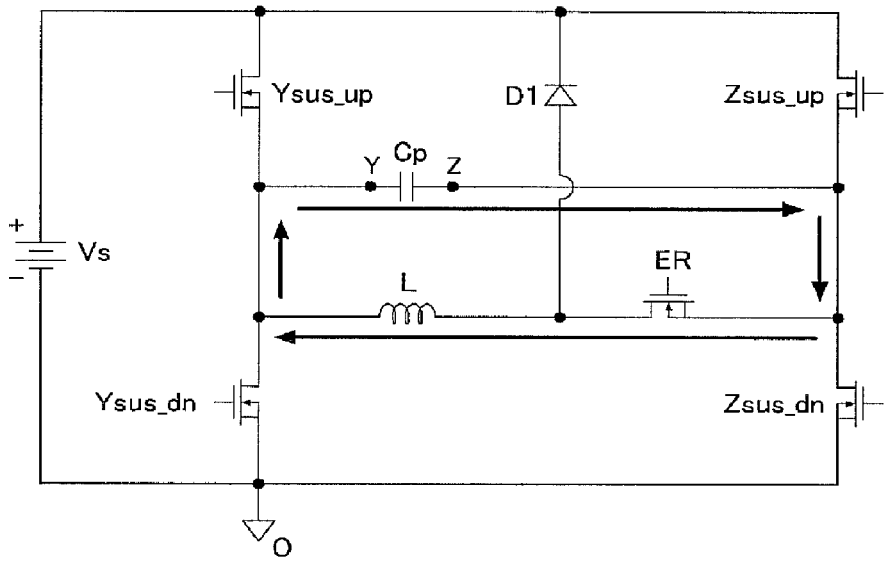

As shown in FIG. 6*e*, the second sustain switch Zsus_up and the second reference switch Ysus_dn are turned off during a time period t4. Resonance is formed between the inductor (L) and the panel Cp. The voltage Vcp between the first and second electrodes Y and Z rises from the negative polarity sustain voltage −Vs to the positive polarity sustain voltage +Vs.

The current IL flows in the first direction D1 at the inductor (L). At a time point when the resonance is generated as the inductor (L) and the PDP are electrically connected, namely, at a time point when the second sustain switch Zsus_up and the second reference switch Ysus_dn are turned off, the size of the current IL flowing at the inductor (L) in the first direction D1 is larger than that of the current in the first direction D1 flowing at the inductor (L) during the time period $t3_2$ in FIG. 6*d*. Accordingly, the size of the current Icp introduced into the panel Cp during the period t4 is increase, so the time period t4 during which the voltage Vcp between the first and second electrodes Y and Z rises is reduced. Accordingly, the drive margin at the sustain period can be improved.

When the size of the current (IL) flowing at the inductor (L) is maximized, the voltage between the first and second electrodes Y and Z becomes the same and the voltage between the first and second electrodes Y and Z becomes the voltage of the ground level. Thereafter, while the voltage between the first and second electrodes Y and Z rises from the voltage of the ground level to the positive polarity sustain voltage +Vs, the current in the first direction flowing at the inductor (L) is gradually reduced.

Figure 6F:
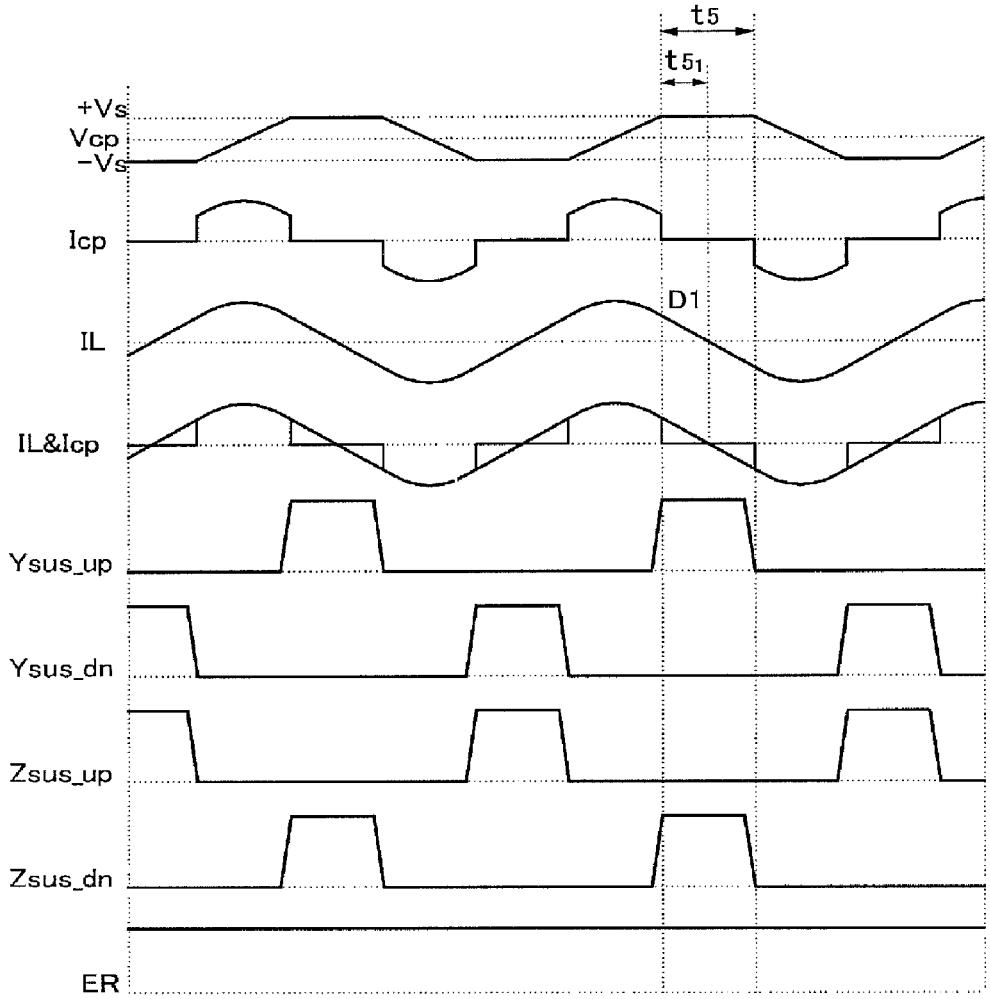
Figure 6F:
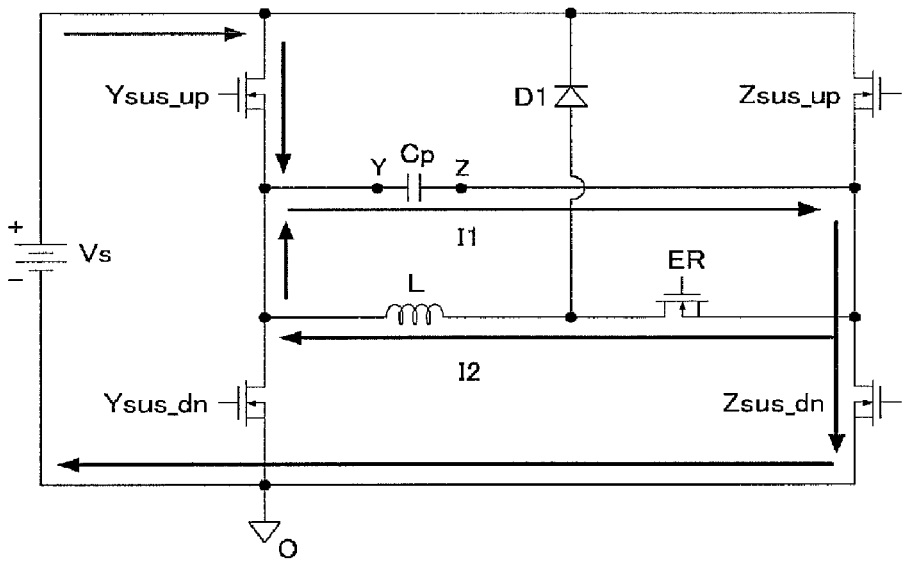

As shown in FIG. 6*f*, during a time period t6, the first sustain switch Ysus_up and the first reference switch Zsus_dn are turned on. During a time period $t5_1$ of the time period t5, first and second current paths I1 and I2 are formed. The voltage Vcp between the first and second electrodes Y and Z is maintained at the positive polarity sustain voltage +Vs by the first current path I1. By the second current path I2, the current in the first direction gradually flows at the inductor (L) and the size of the current in the first direction is gradually reduced.

After the energy charged in the inductor (L) is completely discharged, likewise as the case shown in FIG. 6*a*, during a time period $t5_2$, the direction of the current IL flowing at the inductor (L) is changed to the second direction D2 according to the direction of the second current path I2.

Figure 7:
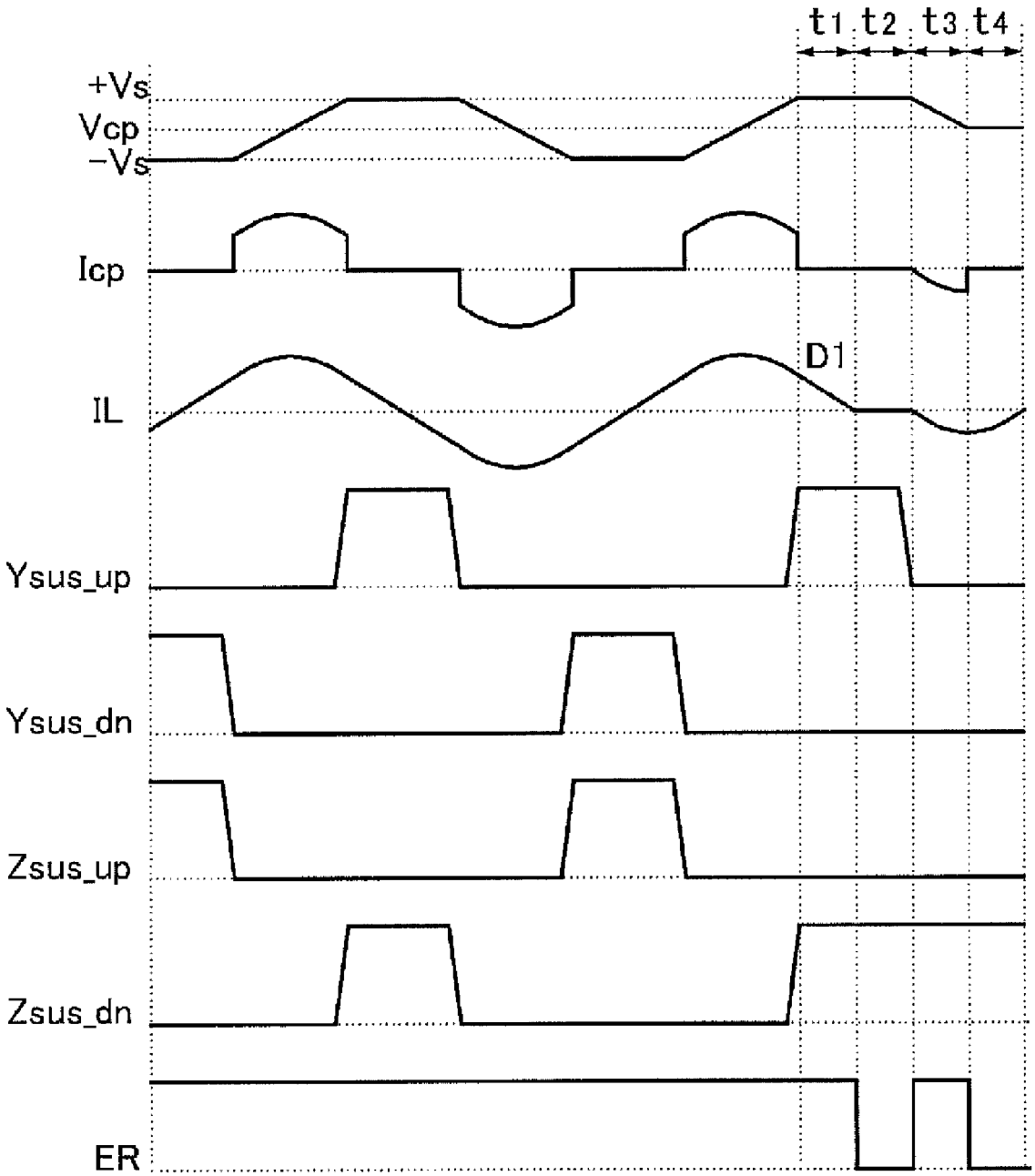
FIG. 7 is a timing diagram illustrating an example of a method of supplying the last sustain signal to the PDP by the sustain driver in FIG. 4.

FIG. 7 is a timing diagram illustrating an example of a method of supplying the last sustain signal to the PDP by the sustain driver in FIG. 4.

The first driver 110 may make the size of the current IL flowing at the inductor (L) 0 during a portion of the time period during which the voltage Vcp between the first and second electrodes Y and Z is maintained at the positive polarity sustain voltage +Vs or the negative polarity sustain voltage −Vs.

For example, as shown in FIG. 7, during the time periods t1 and t2 while the voltage Vcp between the first and second electrodes Y and Z maintained at the positive polarity sustain voltage +Vs is supplied to the panel Cp, the first sustain switch Ysus_up and the first reference switch Zsus_dn are turned on.

The size of the current IL flowing in the first direction D1 at the inductor (L) is gradually reduced during the time period t1. The current IL in the first direction D1 flowing at the inductor (L) is reduced to 0 [A]. After the current IL flowing at the inductor (L) becomes 0 [A], when the resonance switch ER is turned off during the time period t2, the size of the current flowing at the inductor (L) is 0 [A]. Accordingly, the time period during which the voltage Vcp between the first and second electrodes Y and Z is maintained at the sustain voltage can be controlled.

During the t3 period, the first reference switch Zsus_dn is maintained in the ON state and the resonance switch ER is turned on, so the voltage Vep between the first and second electrodes Y and Z falls from the positive polarity sustain voltage +Vs to the voltage GND of the ground level.

During the time period t4, the resonance switch ER is turned off and the first reference switch Zsus_dn is maintained in the ON state, so the voltage Vcp between the first and second electrodes Y and Z is maintained at the voltage of the ground level.

At this time, the sustain signal may be finally supplied at a single subfield. Namely, the positive polarity sustain voltage +Vs or the negative polarity sustain voltage −Vs of the sustain signal may be finally supplied at a single subfield.

FIGS. 8*a* to 8*d* illustrate a current ID1 of the bypass diode D1, a current IER of the resonance switch ER, a current IYsus_dn of the second reference switch Ysus_dn, and a current IZsus_dn of the first reference switch Zsus_dn, in addition to the voltage Vcp of the panel Cp, the current Icp of the panel Cp, and the current IL of the inductor (L).

The first sustain switch Ysus_up is turned on while the voltage Vcp between the first and second electrodes Y and Z is maintained at the positive polarity sustain voltage +Vs, and the first reference switch Zsus_dn is continuously maintained in the ON state starting from the period while the voltage Vcp between the first and second electrodes Y and Z is maintained at the positive polarity sustain voltage +Vs to the time period t4 while it is maintained at the reference voltage GND of the ground level.

Figure 8A:
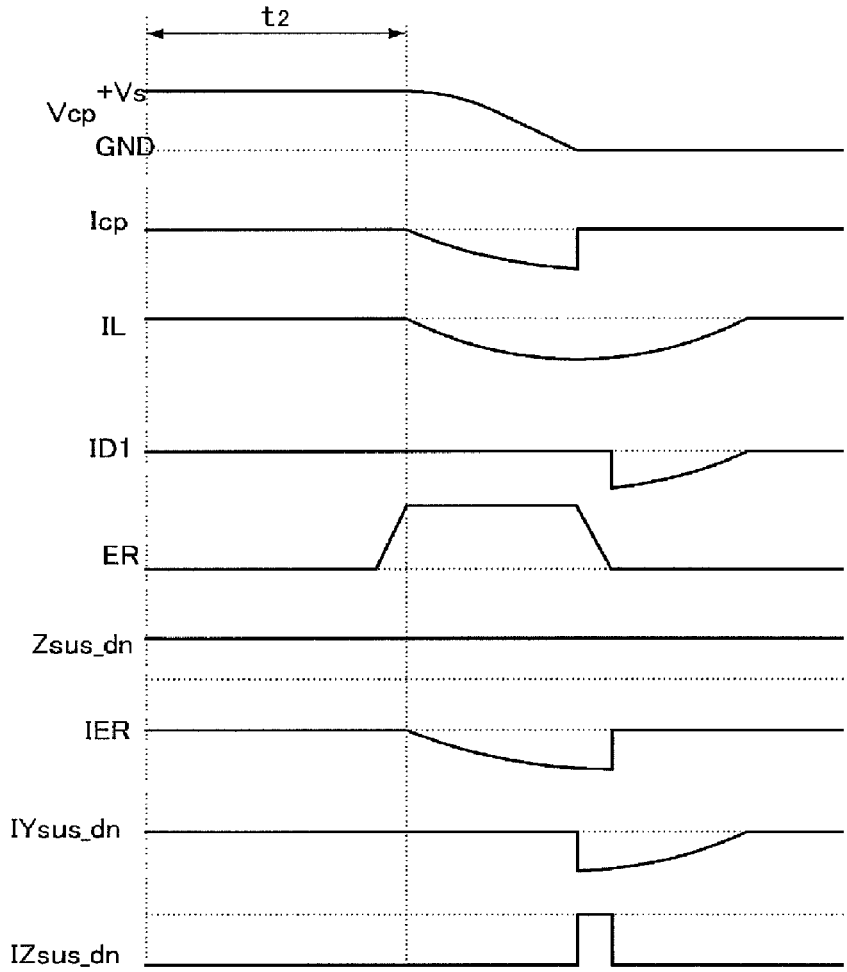
FIGS. 8*a* to 8*d* are views illustrating operations of the sustain driver according to the timing in FIG. 7.
Figure 8A:
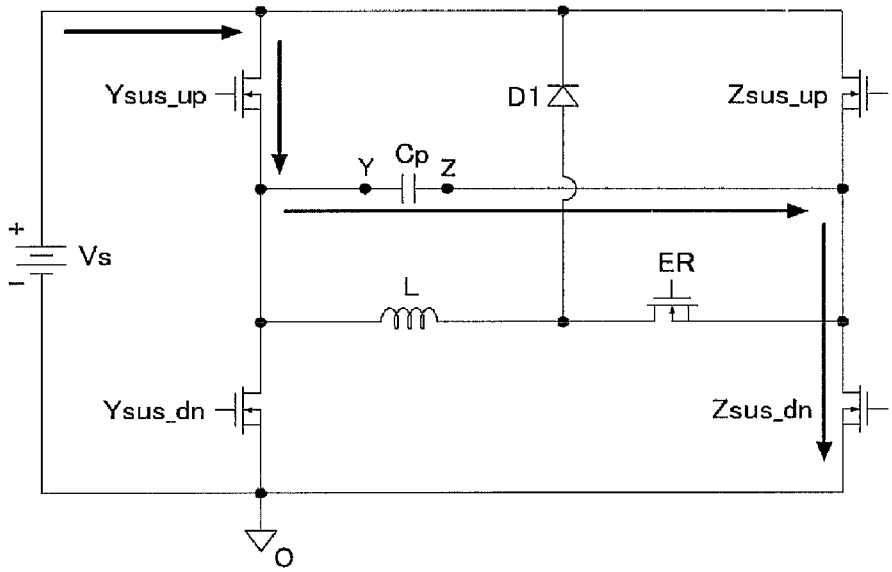

As shown in FIG. 8*a*, during the time period t2, when the size of the current IL flowing at the inductor (L) is 0 [A], the resonance switch ER is turned off to form a current path. Accordingly, the size of the current flowing at the inductor (L) is maintained as 0 [A] during the time period t2, and the voltage Vcp between the first and second electrodes is maintained at the positive polarity sustain voltage +Vs. The time period during which the positive polarity sustain voltage +Vs is maintained can be controlled according to the time period during which the resonance switch ER is turned off.

Figure 8B:
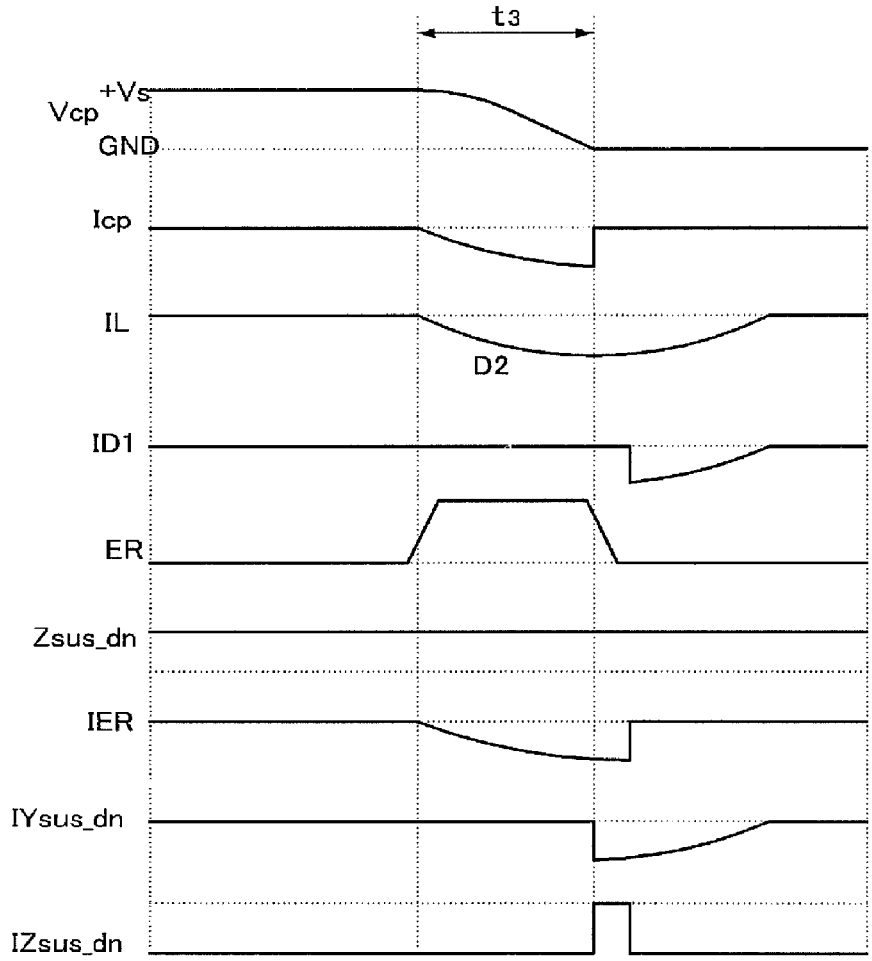
Figure 8B:
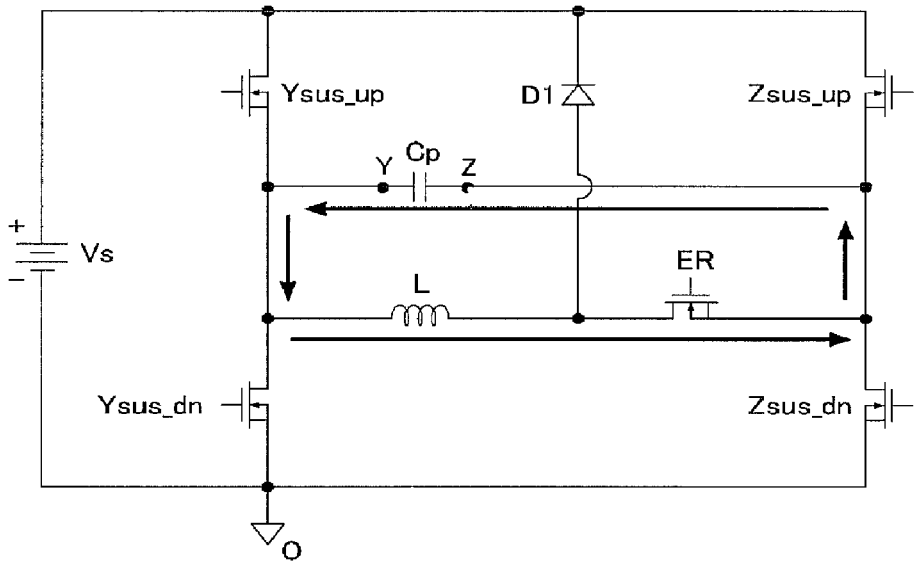

As shown in FIG. 8*b*, during the time period t3, the resonance switch ER is turned on to form a current path. In this case, the first reference switch Zsus_dn is maintained in the ON state. However, because the voltage of the first electrode (Y) is higher than the reference voltage GND of the ground level, the first reference switch Zsus_dn cannot form a current path. According to the current path as shown in FIG. 8*b*, the voltage Vcp between the first and second electrodes Y and Z falls from the positive polarity sustain voltage +Vs to the ground voltage GND of the ground level because of the resonance between the panel Cp and the inductor (L).

The current IL flows in the second direction D2 at the inductor (L), so the voltage Vcp between the first and second electrodes Y and Z falls. While the voltage Vcp between the first and second electrodes Y and Z is falling, the size of the current IL flowing at the inductor (L) is gradually increased. Because the current IL flowing at the inductor (L) is supplied to the second electrodes (Z), the current IL flowing at the inductor (L) is substantially the same as the current Icp of the panel Cp and the current IER flowing at the resonance switch ER.

Accordingly, because the voltage of the first electrodes (Y) and that of the second electrodes (Y) are the same, the voltage Vcp between the first and second electrodes Y and Z falls from the positive polarity sustain voltage +Vs to the reference voltage GND of the ground level.

Figure 8C:
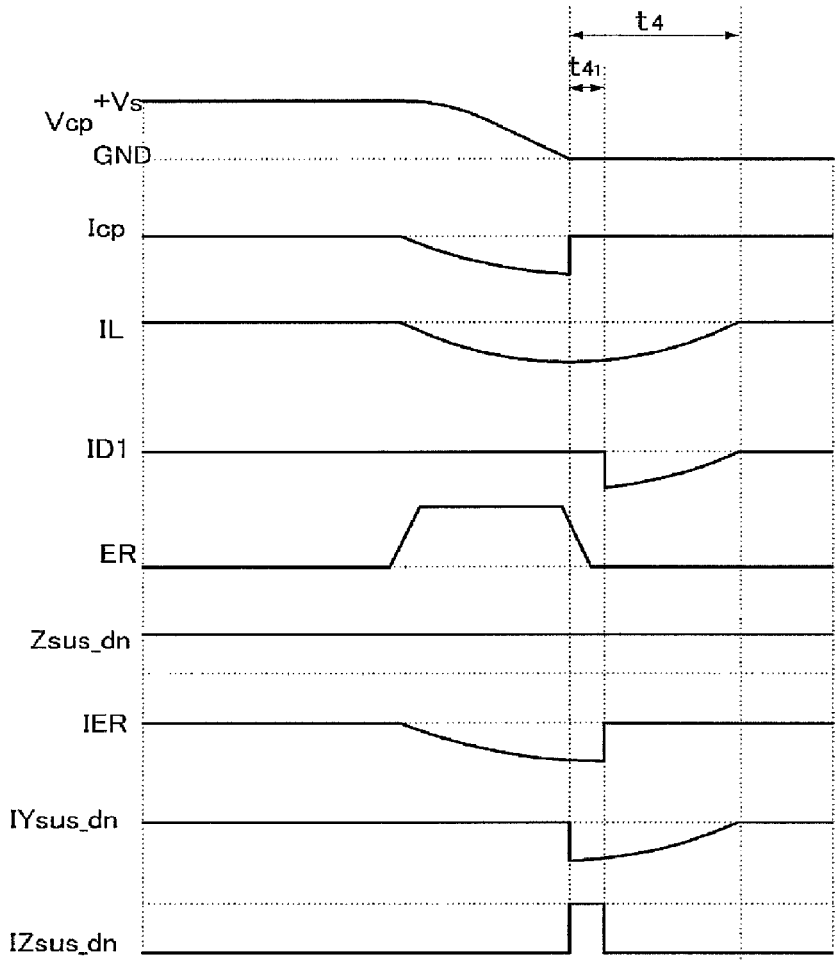
Figure 8C:
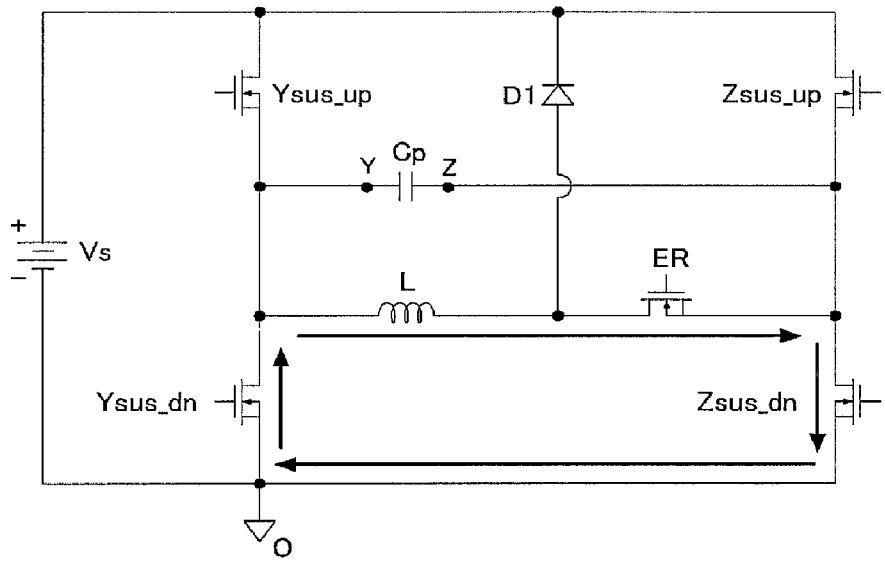

FIG. 8*c* shows a current path formed due to a transitional state of the resonance switch ER when the resonance switch ER is turned off during $t4_1$ of the time period t4. Because the voltage of the first electrodes (Y) becomes the reference voltage GND of the ground level and the current IL of the inductor (L) is maintained in the second direction D2, the current path as shown in FIG. 8*c* is formed.

Figure 8D:
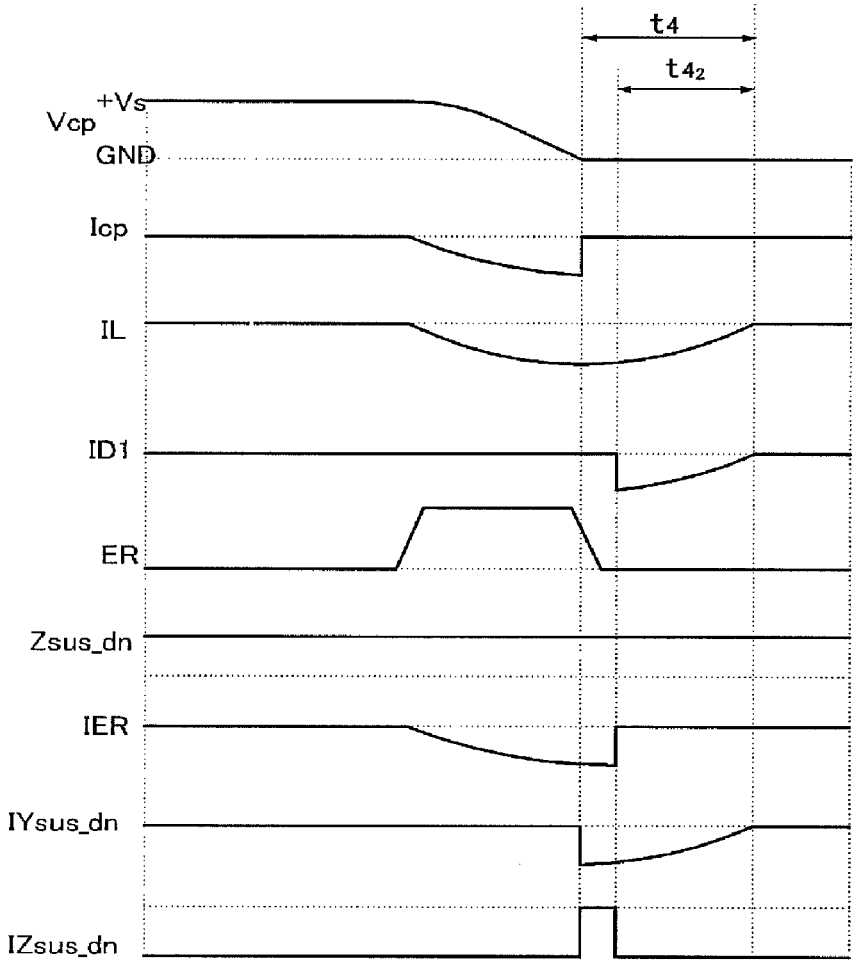
Figure 8D:
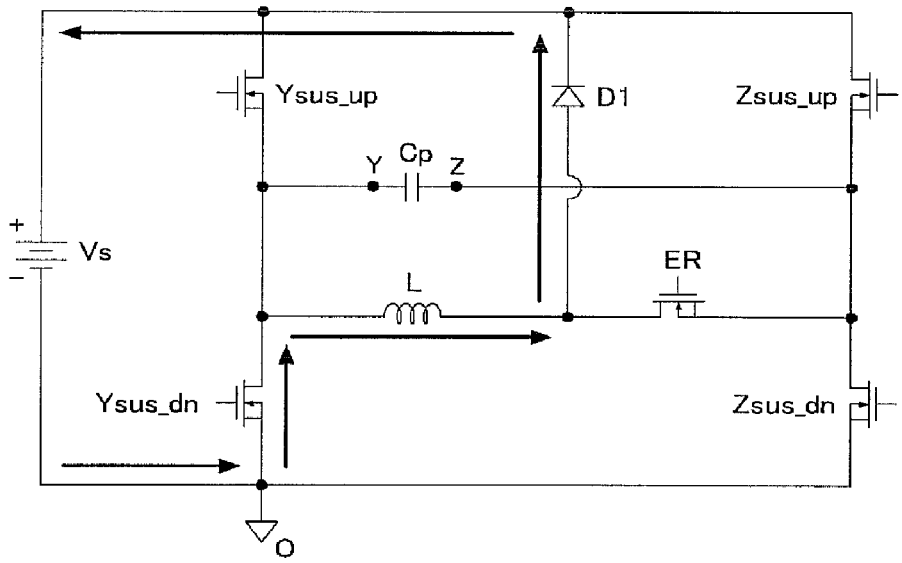

Thereafter, when the resonance switch ER gets out of the transitional state and is completely turned off during $t4_2$ of the time period t4, a current path as shown in FIG. 8*d* is formed. After the resonance switch ER is turned off, the current IL flowing at the inductor (L) flows to the positive polarity constant voltage source SCE via the bypass diode D1 according to the current path as shown in FIG. 8*d*.

Namely, the current flowing at the inductor (L) is not instantaneously changed to 0 [A] due to a counter electromotive force but gradually reduced, so the current continuously flows at the inductor (L).

If the current IL flowing at the inductor (L) is continuously introduced to the second electrodes (Z) even after the voltage Vcp between the first and second electrodes Y and Z falls to the reference voltage GND of the ground level, the voltage Vcp between the first and second electrodes Y and Z is bound to fall to below the reference voltage GND of the ground level. In this case, the bypass diode D1 serves to prevent the voltage Vcp between the first and second electrodes Y and Z from falling to below the reference voltage GND of the ground level.

In the above description, the sustain driver as shown in FIG. 4 has been taken as an example, but alternatively, in the sustain driver, the positions of the inductor unit and the resonance controller may be changed mutually. Also, in the above description, the positive polarity constant voltage is received from the single positive polarity constant voltage source to supply the positive or negative sustain voltage is supplied to the first and second electrodes of the panel, but alternatively, constant voltages may be received from two constant voltage sources to supply sustain signals to the first and second electrodes. Or, a circuit may be formed such that a positive polarity sustain signal or a negative polarity sustain signal is supplied only to the first or second electrodes.

In addition, in the above description, the voltage Vcp between the first and second electrodes Y and Z falls from the positive polarity sustain voltage +Vs to the reference voltage GND of the ground level. But alternatively, when the sustain driver is reconstructed such that the inductor (L) and the resonance switch ER are mutually changed in their positions, the voltage Vcp between the first and second electrodes Y and Z may rise from the negative polarity sustain voltage −Vs to the reference voltage GND of the ground level.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including a first electrode and a second electrode;

a first sustain controller configured to include a first sustain switch and a first reference switch;

a second sustain controller configured to include a second sustain switch and a second reference switch;

an inductor unit into which a current flows in a first direction before and after a voltage between the first electrode and the second electrode rises from a negative polarity sustain voltage and into which a current flows in a second direction different from the first direction before and after the voltage between the first electrode and the second electrode falls from a positive polarity sustain voltage;

a resonance controller configured to control resonance between the plasma display panel and the inductor unit; and a bypass unit including a bypass diode, wherein a first terminal of the first sustain switch is connected to a positive polarity constant voltage source and a second terminal of the first sustain switch is connected to the first electrode, a first terminal of the first reference switch is connected to a reference voltage source of a ground level and a second terminal of the first reference switch is connected to the second electrode, a first terminal of the second sustain switch is commonly connected to the positive polarity constant voltage source and the first terminal of the first sustain switch and a second terminal of the second sustain switch is commonly connected to the second electrode and the second terminal of the first reference switch, a first terminal of the second reference switch is commonly connected to the reference voltage source of a ground level and the first terminal of the first reference switch and a second terminal of the second reference switch is commonly connected to the first electrode and the second terminal of the first sustain switch, a first terminal of the inductor unit is commonly connected to the first electrode, the second terminal of the first sustain switch and the second terminal of the second reference switch, a first terminal of the resonance controller is connected to a second terminal of the inductor unit and a second terminal of the resonance controller is commonly connected to the second electrode, the second terminal of the second sustain switch and the second terminal of the first reference switch, and a cathode terminal of the bypass diode is commonly connected to the positive polarity constant voltage source, the first terminal of the first sustain switch and the first terminal of the second sustain switch, and an anode terminal of the bypass diode is commonly connected to the second terminal of the inductor unit and the first terminal of the resonance controller.

2. The plasma display apparatus of claim 1, wherein while the voltage between the first electrode and the second electrode is maintained at the positive polarity sustain voltage, a direction of a current flowing into the inductor unit changes from the first direction to the second direction, and while the voltage between the first electrode and the second electrode is maintained at the negative polarity sustain voltage, a direction of a current flowing into the inductor unit changes from the second direction to the first direction.

3. The plasma display apparatus of claim 2, wherein while the voltage between the first electrode and the second electrode is maintained at the positive polarity sustain voltage, a magnitude of the current flowing into the inductor unit in the first direction gradually decreases until the direction of the current flowing into the inductor unit changes from the first direction to the second direction.

4. The plasma display apparatus of claim 2, wherein while the voltage between the first electrode and the second electrode is maintained at the positive polarity sustain voltage, a magnitude of the current flowing into the inductor unit in the second direction gradually increases.

5. The plasma display apparatus of claim 2, wherein while the voltage between the first electrode and the second electrode falls from the positive polarity sustain voltage to the negative polarity sustain voltage, a direction of the current flowing into the inductor unit is maintained at the second direction.

6. The plasma display apparatus of claim 2, wherein while the voltage between the first electrode and the second electrode is maintained at the positive polarity sustain voltage, a magnitude of the current flowing into the inductor unit in the second direction gradually decreases until the direction of the current flowing into the inductor unit changes from the second direction to the first direction.

7. The plasma display apparatus of claim 2, wherein while the voltage between the first electrode and the second electrode is maintained at the negative polarity sustain voltage, a magnitude of the current flowing into the inductor unit in the first direction gradually increases.

8. The plasma display apparatus of claim 2, wherein while the voltage between the first electrode and the second electrode rises from the negative polarity sustain voltage to the positive polarity sustain voltage, a direction of the current flowing into the inductor unit is maintained at the first direction.

9. The plasma display apparatus of claim 2, wherein a magnitude of a current flowing into the inductor unit at a time when the inductor unit is electrically connected to the plasma display panel is larger than a magnitude of a current flowing into the inductor unit while the voltage between the first electrode and the second electrode is maintained at the positive polarity sustain voltage or the negative polarity sustain voltage.

10. The plasma display apparatus of claim 1, wherein while the voltage between the first electrode and the second electrode is maintained at the positive polarity sustain voltage or the negative polarity sustain voltage, a magnitude of a current flowing into the inductor unit gradually decreases and is 0 ampere.

11. The plasma display apparatus of claim 10, wherein the positive polarity sustain voltage or the negative polarity sustain voltage is lastly supplied in one subfield.

12. The plasma display apparatus of claim 2, wherein the positive polarity sustain voltage or the negative polarity sustain voltage is supplied from one positive polarity constant voltage source.

13. The plasma display apparatus of claim 1, wherein the first sustain controller is configured to supply a positive polarity voltage supplied from the positive polarity constant voltage source to the first electrode so that a voltage between the first electrode and the second electrode is maintained at the positive polarity sustain voltage and the second sustain controller configured to supply the positive polarity sustain voltage to the second electrode so that a voltage between the first electrode and the second electrode is maintained at a negative polarity sustain voltage.

14. The plasma display apparatus of claim 1, wherein while the first sustain switch and the first reference switch are turned on, a voltage between the first electrode and the second electrode is maintained at the positive sustain voltage, and while a voltage between the first electrode and the second electrode is maintained at the positive sustain voltage, a direction of a current into the inductor unit changes from the first direction to the second direction.

15. The plasma display apparatus of claim 14, wherein while the voltage between the first electrode and the second electrode is maintained at the positive polarity sustain voltage, a magnitude of the current flowing into the inductor unit in the first direction gradually decreases until the direction of the current flowing into the inductor unit changes from the first direction to the second direction.

16. The plasma display apparatus of claim 14, wherein while the voltage between the first electrode and the second electrode is maintained at the positive polarity sustain voltage, a magnitude of the current flowing into the inductor unit in the second direction gradually increases.

17. The plasma display apparatus of claim 14, wherein while the first sustain switch and the first reference switch are turned off, the voltage between the first electrode and the second electrode falls from the positive polarity sustain voltage to the negative polarity sustain voltage and a direction of the current flowing into the inductor unit is maintained at the second direction.

18. The plasma display apparatus of claim 17, wherein a magnitude of a current flowing into the inductor unit in the second direction at a time when the inductor unit is electrically connected to the plasma display panel is larger than a magnitude of a current flowing into the inductor unit in the second direction while the voltage between the first electrode and the second electrode is maintained at the positive polarity sustain voltage.

19. The plasma display apparatus of claim 1, wherein while the second sustain switch and the second reference switch are turned on, a voltage between the first electrode and the second electrode is maintained at the negative sustain voltage, and while a voltage between the first electrode and the second electrode is maintained at the negative voltage, a direction of a current into the inductor unit changes from the second direction to the first direction.

20. The plasma display apparatus of claim 19, wherein while the voltage between the first electrode and the second electrode is maintained at the negative polarity sustain voltage, a magnitude of the current flowing into the inductor unit in the second direction gradually decreases until the direction of the current flowing into the inductor unit changes from the second direction to the first direction.

21. The plasma display apparatus of claim 19, wherein while the voltage between the first electrode and the second electrode is maintained at the negative polarity sustain voltage, a magnitude of the current flowing into the inductor unit in the first direction gradually increases.

22. The plasma display apparatus of claim 19, wherein while the second sustain switch and the second reference switch are turned off, the voltage between the first electrode and the second electrode rises from the negative polarity sustain voltage to the positive polarity sustain voltage and a direction of the current flowing into the inductor unit is maintained at the first direction.

23. The plasma display apparatus of claim 22, wherein a magnitude of a current flowing into the inductor unit in the first direction at a time when the inductor unit is electrically connected to the plasma display panel is larger than a magnitude of a current flowing into the inductor unit in the first direction while the voltage between the first electrode and the second electrode is maintained at the negative polarity sustain voltage.

24. The plasma display apparatus of claim 1, wherein the resonance controller is configured to control such that the voltage between the first electrode and the second electrode falls from the positive polarity sustain voltage to the ground level reference voltage or rises from the negative polarity sustain voltage to the ground level reference voltage because of resonance formed by the plasma display panel and the inductor unit.

25. The plasma display apparatus of claim 1, wherein the resonance controller is turned off so that a magnitude of a current flowing into the inductor unit is 0 ampere during a portion of a period when the voltage between the first electrode and the second electrode is maintained at the positive sustain voltage or the negative sustain voltage.

26. The plasma display apparatus of claim 1, wherein the resonance controller is turned on so that the voltage between the first electrode and the second electrode falls from the positive sustain voltage to the ground level reference voltage by the resonance or a voltage of the second sustain signal rises from the ground level reference voltage to the positive sustain voltage by the resonance.

27. The plasma display apparatus of claim 1, wherein while a voltage of the second sustain signal is maintained at the reference voltage after the resonance, the resonance controller is turned off, and after the resonance controller is turned off, a current flowing into the inductor unit is discharged from the positive constant voltage source through the bypass unit.

28. A plasma display apparatus comprising:

a plasma display panel having a first electrode and a second electrode;

a first sustain controller that includes a first sustain switch and a first reference switch, wherein a first terminal of the first sustain switch is coupled to a positive polarity voltage source and a second terminal of the first sustain switch is coupled to the first electrode, wherein a first terminal of the first reference switch is coupled to a ground level and a second terminal of the first reference switch is coupled to the second electrode, wherein a first terminal of the second sustain switch is coupled to the positive polarity voltage source and to the first terminal of the first sustain switch, and a second terminal of the second sustain switch is coupled to the second electrode and to the second terminal of the first reference switch;

a second sustain controller that includes a second sustain switch and a second reference switch, wherein a first terminal of the second reference switch is coupled to the ground level and to the first terminal of the first reference switch, and a second terminal of the second reference switch is coupled to the first electrode and to the second terminal of the first sustain switch;

an inductor unit having a first terminal and a second terminal, wherein the inductor unit is configured such that a current flows in a first direction from the first terminal of the inductor unit to the second terminal of the inductor unit before and after a voltage between the first electrode and the second electrode increases from a negative polarity sustain voltage, and the inductor unit is configured such that a current flows in a second direction from the second terminal of the inductor unit to the first terminal of the inductor unit before and after the voltage between the first electrode and the second electrode decreases from a positive polarity sustain voltage, wherein the first terminal of the inductor unit is coupled to the first electrode, to the second terminal of the first sustain switch and to the second terminal of the second reference switch;

a resonance controller to control resonance between the plasma display panel and the inductor unit, wherein a first terminal of the resonance controller is coupled to the second terminal of the inductor unit and a second terminal of the resonance controller is coupled to the second electrode, to the second terminal of the second sustain switch and to the second terminal of the first reference switch; and a bypass unit that includes a bypass diode having a cathode terminal and an anode terminal, wherein the cathode terminal is coupled to the positive polarity voltage source, to the first terminal of the first sustain switch and to the first terminal of the second sustain switch, and the anode terminal is coupled to the second terminal of the inductor unit and to the first terminal of the resonance controller.

* * * * *